US007391427B2

(12) United States Patent
LeBlanc

(10) Patent No.: US 7,391,427 B2
(45) Date of Patent: Jun. 24, 2008

(54) PARAMETRIC PROGRAMMABLE THERMAL PRINTER

(75) Inventor: Thomas J. LeBlanc, Canton, MA (US)

(73) Assignee: Zink Imaging, LLC, Bedford, MA (US)

( * ) Notice: Subject to any disclaimer, the term of this patent is extended or adjusted under 35 U.S.C. 154(b) by 227 days.

(21) Appl. No.: 11/168,676

(22) Filed: Jun. 28, 2005

(65) Prior Publication Data

US 2006/0290770 A1 Dec. 28, 2006

(51) Int. Cl.
*B41J 2/00* (2006.01)

(52) U.S. Cl. ..... 347/188

(58) Field of Classification Search ..... 347/172–173, 347/183–185, 188, 189, 190, 191–192, 194, 347/195; 400/120.02, 120.07, 120.09, 120.11, 400/120.12, 120.14, 120.15
See application file for complete search history.

(56) References Cited

U.S. PATENT DOCUMENTS

| | | | | |
|---|---|---|---|---|
| 4,434,354 | A | 2/1984 | Nakata | |
| 5,319,258 | A | 6/1994 | Ruetz | 307/443 |
| 5,783,963 | A | 7/1998 | Garnett et al. | 327/306 |
| 6,128,098 | A | 10/2000 | Kamada et al. | 358/1.8 |
| 6,345,875 | B1 | 2/2002 | Fuller et al. | 347/9 |
| 6,637,325 | B2 | 10/2003 | Inamine | 101/128.4 |
| 6,661,443 | B2 | 12/2003 | Bybell et al. | 347/190 |
| 6,801,233 | B2 | 10/2004 | Bhatt et al. | 347/175 |
| 2002/0191066 | A1 | 12/2002 | Bouchard et al. | |
| 2005/0007438 | A1 | 1/2005 | Busch et al. | 347/175 |

FOREIGN PATENT DOCUMENTS

| | | | |
|---|---|---|---|
| EP | 0 458 507 | B1 | 11/1991 |
| EP | 1 266 762 | B1 | 12/2002 |
| EP | 1 321 296 | B1 | 6/2003 |
| JP | 2000-293328 | | 10/2000 |
| JP | 2000 293328 | A | 10/2000 |

OTHER PUBLICATIONS

PCT International Search Report (PCT/US2006/025097); Date of Mailing Feb. 13, 2007; 2 Pages.

*Primary Examiner*—Kristal J Feggins
(74) *Attorney, Agent, or Firm*—Foley & Lardner LLP; Michael Morency; James F. Ewing

(57) ABSTRACT

A parametric programmable thermal printer is disclosed. The printer may include a controller that performs functions such as thermal history control and common mode voltage correction. The controller may be implemented in an integrated programmable medium such as a Field-Programmable Gate Array (FPGA). Functions performed by the controller may be parameterized, and parameter values may be stored in registers. The controller may be used with a different thermal printer by changing the parameter values and/or reprogramming the programmable medium, and without otherwise redesigning or remanufacturing the controller.

6 Claims, 11 Drawing Sheets

PARAMETRIC PROGRAMMABLE THERMAL PRINTER

CROSS REFERENCE TO RELATED APPLICATIONS

This application is related to the following commonly-owned patent applications and patents, which are hereby incorporated by reference:

patent application Ser. No. 10/910,880, filed on Aug. 4, 2004, entitled "Thermal Response Correction System";

U.S. Pat. No. 6,661,443 to Bybell and Thornton, issued on Dec. 9, 2003, entitled "Method and Apparatus for Voltage Correction"; and U.S. Pat. No. 6,801,233 to Bhatt et al., issued Oct. 5, 2004, entitled "Thermal Imaging System".

BACKGROUND

1. Field of the Invention

The present invention relates to thermal printers and, more particularly, to techniques for controlling thermal print heads.

2. Related Art

Thermal printers typically contain a linear array of heating elements (also referred to herein as "print head elements") that print on an output medium by, for example, transferring pigment or dye from a donor sheet to the output medium or by activating a color-forming chemistry in the output medium. The output medium is typically a porous receiver receptive to the transferred pigment, or a paper coated with the color-forming chemistry. Each of the print head elements, when activated, forms color on the medium passing underneath the print head element, creating a spot having a particular density. Regions with larger or denser spots are perceived as darker than regions with smaller or less dense spots. Digital images are rendered as two-dimensional arrays of very small and closely-spaced spots.

A thermal print head element is activated by providing it with energy. Providing energy to the print head element increases the temperature of the print head element, causing either the transfer of pigment to the output medium or the formation of color in the receiver. The density of the output produced by the print head element in this manner is a function of the amount of energy provided to the print head element. The amount of energy provided to the print head element may be varied by, for example, varying the amount of power to the print head element within a particular time interval or by providing power to the print head element for a longer time interval.

In conventional thermal printers, the time during which a digital image is printed is divided into fixed time intervals referred to herein as "print head cycles." Typically, a single row of pixels (or portions thereof) in the digital image is printed during a single print head cycle. Each print head element is typically responsible for printing pixels (or sub-pixels) in a particular column of the digital image. During each print head cycle, an amount of energy is delivered to each print head element that is calculated to raise the temperature of the print head element to a level that will cause the print head element to produce output having the desired density. Varying amounts of energy may be provided to different print head elements based on the varying desired densities to be produced by the print head elements.

One problem with conventional thermal printers results from the fact that their print head elements retain heat after the conclusion of each print head cycle. This retention of heat can be problematic because, in some thermal printers, the amount of energy that is delivered to a particular print head element during a particular print head cycle is typically calculated based on an assumption that the print head element's temperature at the beginning of the print head cycle is a known fixed temperature. Since, in reality, the temperature of the print head element at the beginning of a print head cycle depends on (among other things) the amount of energy delivered to the print head element during previous print head cycles, the actual temperature achieved by the print head element during a print head cycle may differ from the desired temperature, thereby resulting in a higher or lower output density than is desired. Further complications are similarly caused by the fact that the current temperature of a particular print head element is influenced not only by its own previous temperatures—referred to herein as its "thermal history"—but by the ambient (room) temperature, the thermal histories of other print head elements in the print head, and the temperature of the output medium (film/media) and other thermal printer elements, such as the platen roller and the preheat contact with the thermal heat sink of the Thermal Print Head (TPH).

Various techniques have been applied to counterbalance these undesirable effects of the thermal history of a thermal print head. Such techniques are referred to generally as "thermal history control." Examples of such techniques are disclosed in the above-referenced patent application entitled "Thermal Response Correction System."

Different numbers and combinations of thermal print head elements may be active at different times when printing a digital image, depending on the intensities of the pixels in the digital image. As a result of the circuitry that is typically used to provide power to the print head elements in a thermal printer, spots that are printed by a large number of contemporaneously active print head elements appear lighter than spots that are printed by a small number of contemporaneously active print head elements. This difference in rendered intensity is undesirable because it corresponds to the number of contemporaneously active print head elements, rather than to the intensities of the pixels in the source image being printed. The result is a printed image having undesired variations in intensity that do not accurately reflect the intensities of the pixels in the source image being printed. Examples of techniques for reducing the dependence of density on the number of contemporaneously active print head elements are disclosed in the above-reference patent entitled "Method and Apparatus for Voltage Correction."

In conventional thermal imaging systems, printing multiple colors requires printing in multiple passes (one pass for each color). In the system disclosed in the above-referenced patent application entitled "Thermal Imaging System," the print head is capable of writing up to three colors in a single pass on a single print medium. Each print line time is divided in up to three parts. It is possible to write one color in one part of the line time and another color in another part of the line time. The time division between the three colors, however, may not be equal. For example, if printing yellow and magenta, the yellow may be printed during a smaller fraction of the line time interval than magenta.

Integrating these and other features of a thermal printer into a single thermal imaging system presents a variety of challenges. For example, print data must be processed sufficiently quickly to provide the thermal print head(s) with a continual stream of data to avoid pauses in printing. Data must be stored and transmitted among components of the system efficiently to limit the size and cost of the overall system. Typically, the resulting integrated system includes a combination of analog and digital circuitry that is customized for use with a particular thermal printer. As a result, the system must typically be redesigned to work with a different thermal printer. Such redesign is tedious, time-consuming, and expensive.

What is needed, therefore, are improved techniques for processing print data and controlling print heads in a thermal printer.

SUMMARY

A parametric programmable thermal printer is disclosed. The printer may include a controller that performs functions such as thermal history control and common mode voltage correction. The controller may be implemented in an integrated programmable medium such as a Field-Programmable Gate Array (FPGA). Functions performed by the controller may be parameterized, and parameter values may be stored in registers. The controller may be used with a different thermal printer by changing the parameter values and/or reprogramming the programmable medium, and without otherwise redesigning or remanufacturing the controller.

A parametric programmable thermal printer is disclosed. The printer may include a controller that performs functions such as thermal history control and common mode voltage correction. The controller may be implemented in an integrated programmable medium such as a Field-Programmable Gate Array (FPGA). Functions performed by the controller may be parameterized, and parameter values may be stored in registers. The controller may be used with a different thermal printer by changing the parameter values and/or reprogramming the programmable medium, and without otherwise redesigning or remanufacturing the controller.

Other features and advantages of various aspects and embodiments of the present invention will become apparent from the following description and from the claims.

BRIEF DESCRIPTION OF THE DRAWINGS

FIGS. 1A-1J are block diagrams of a thermal print head controller according to one embodiment of the present invention.

DETAILED DESCRIPTION

A parametric programmable thermal printer is disclosed. The printer may include a controller that performs functions such as thermal history control and common mode voltage correction. The controller may be implemented in an integrated programmable medium such as a Field-Programmable Gate Array (FPGA). Functions performed by the controller may be parameterized, and parameter values may be stored in registers. The controller may be used with a different thermal printer by changing the parameter values and/or reprogramming the programmable medium, and without otherwise redesigning or remanufacturing the controller.

Figure 1A:
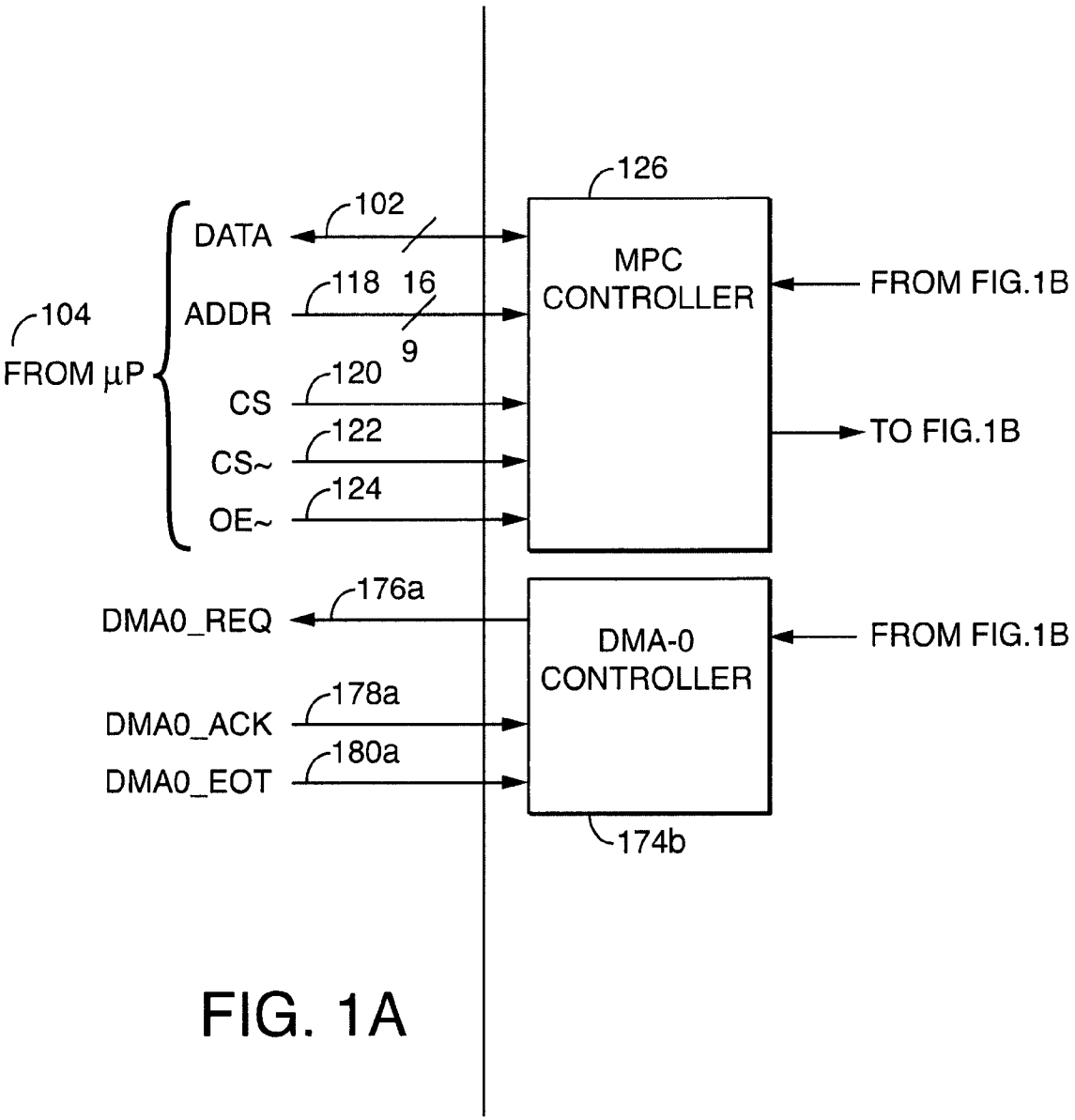
Figure 1B:
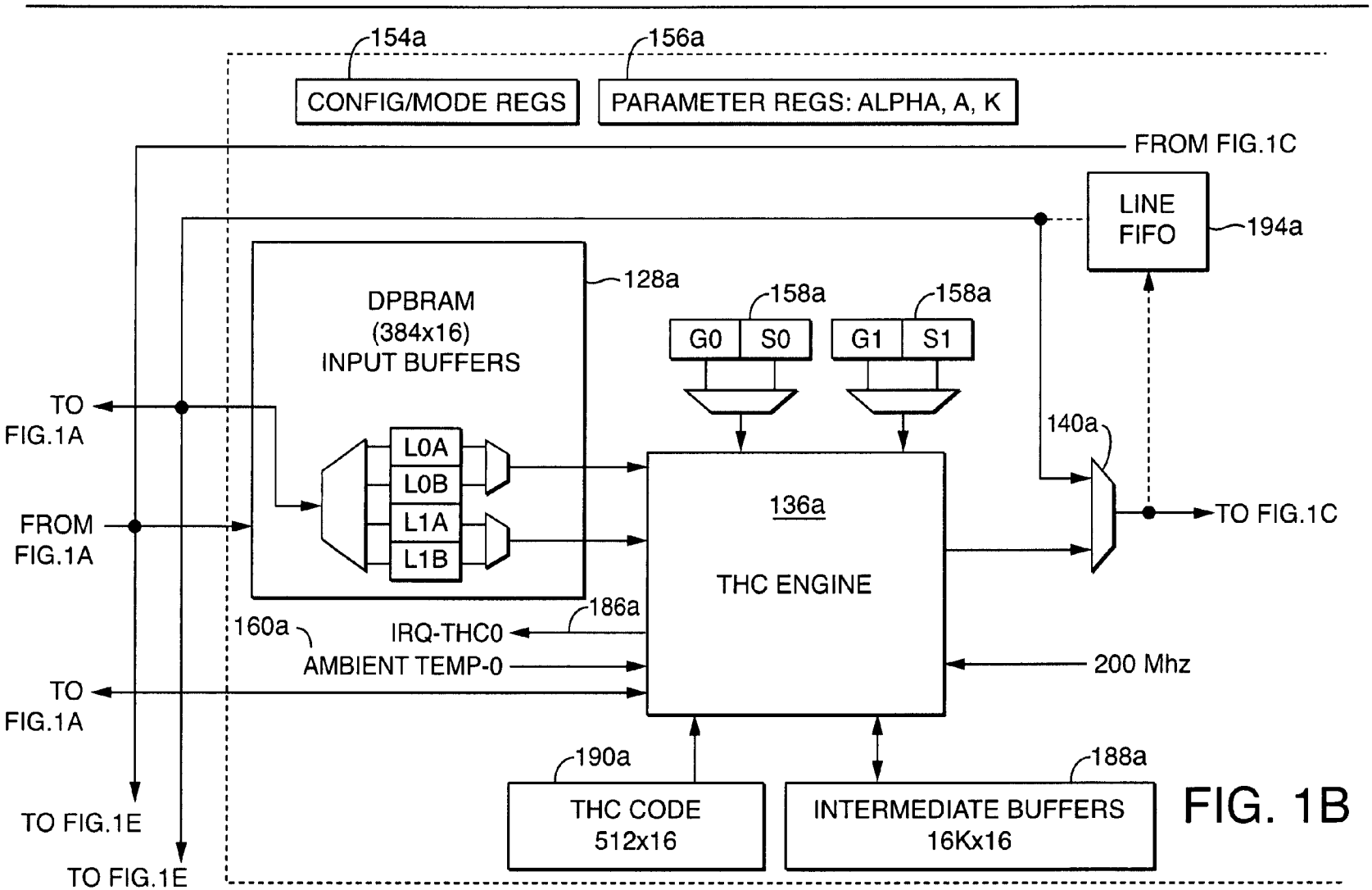
Figure 1C:
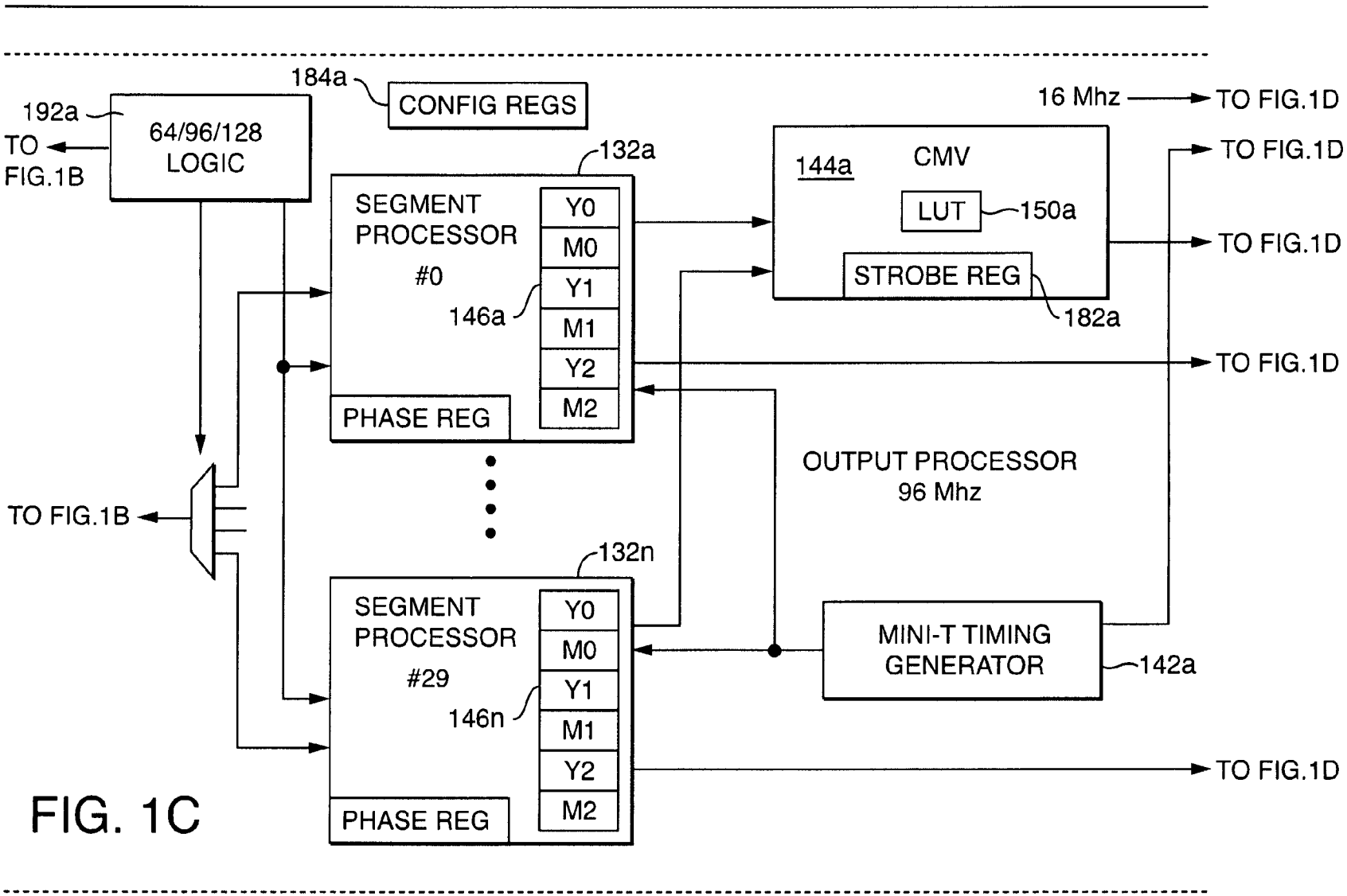
Figure 1D:
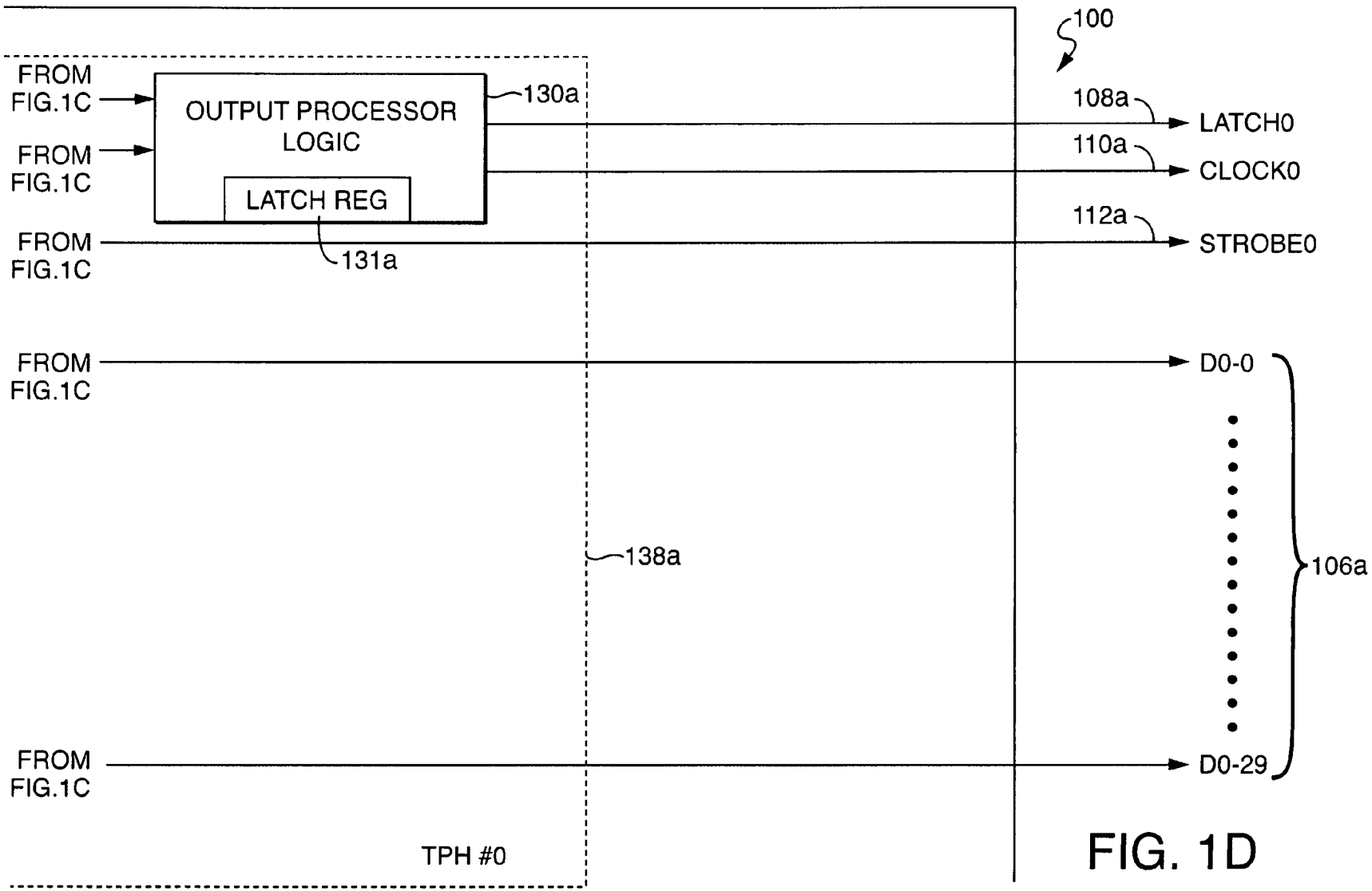
Figure 1E:
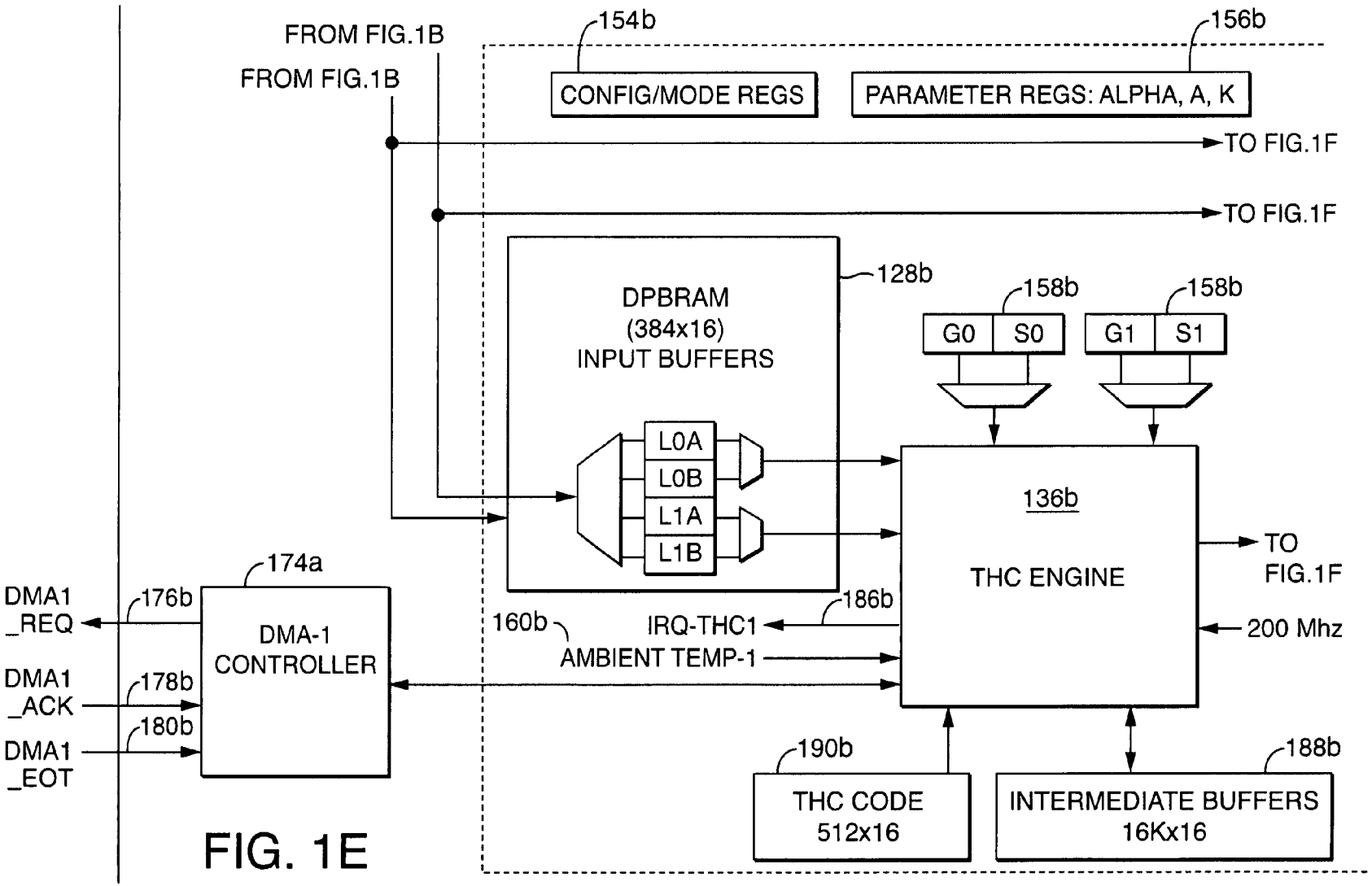
Figure 1F:
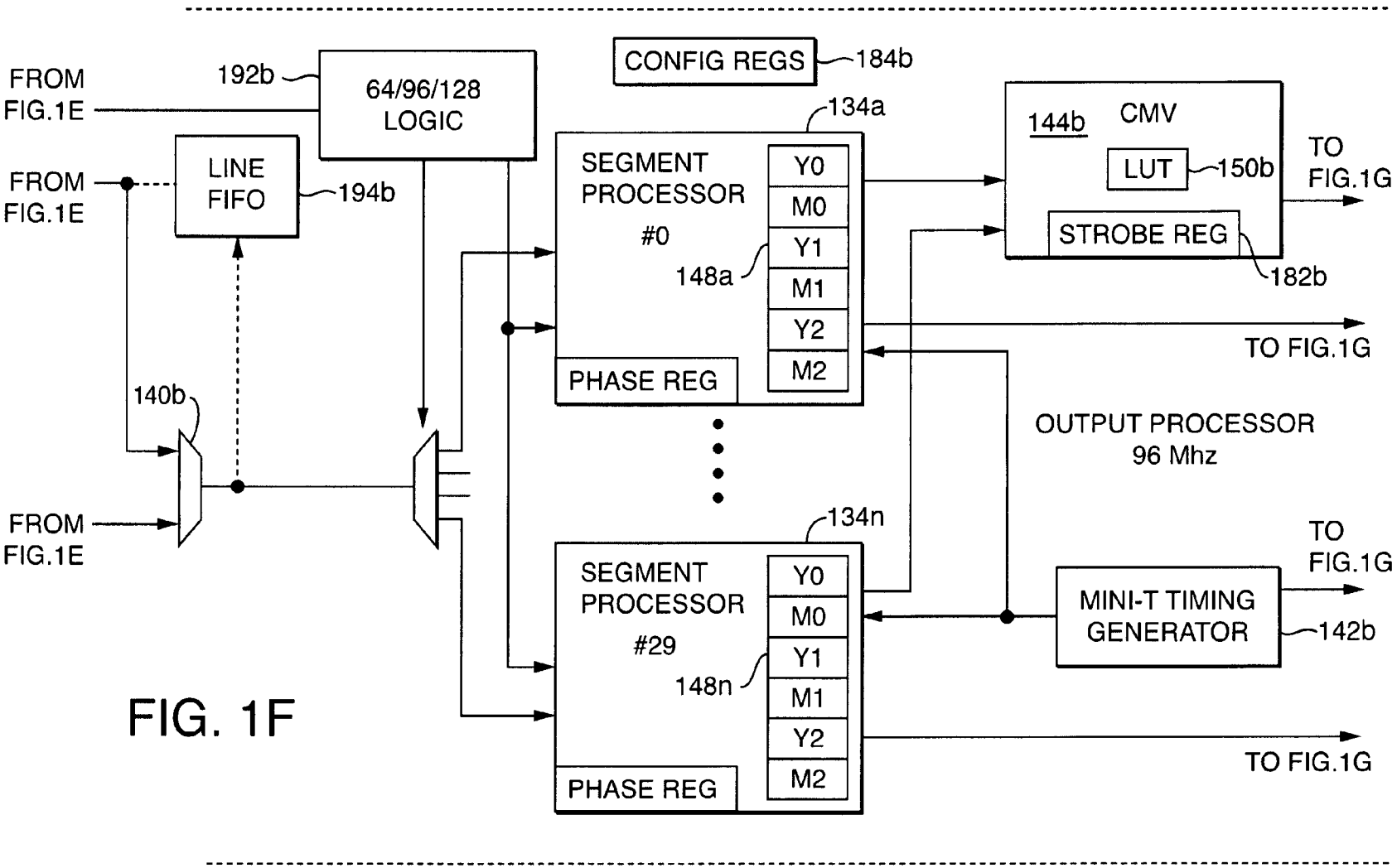
Figure 1G:
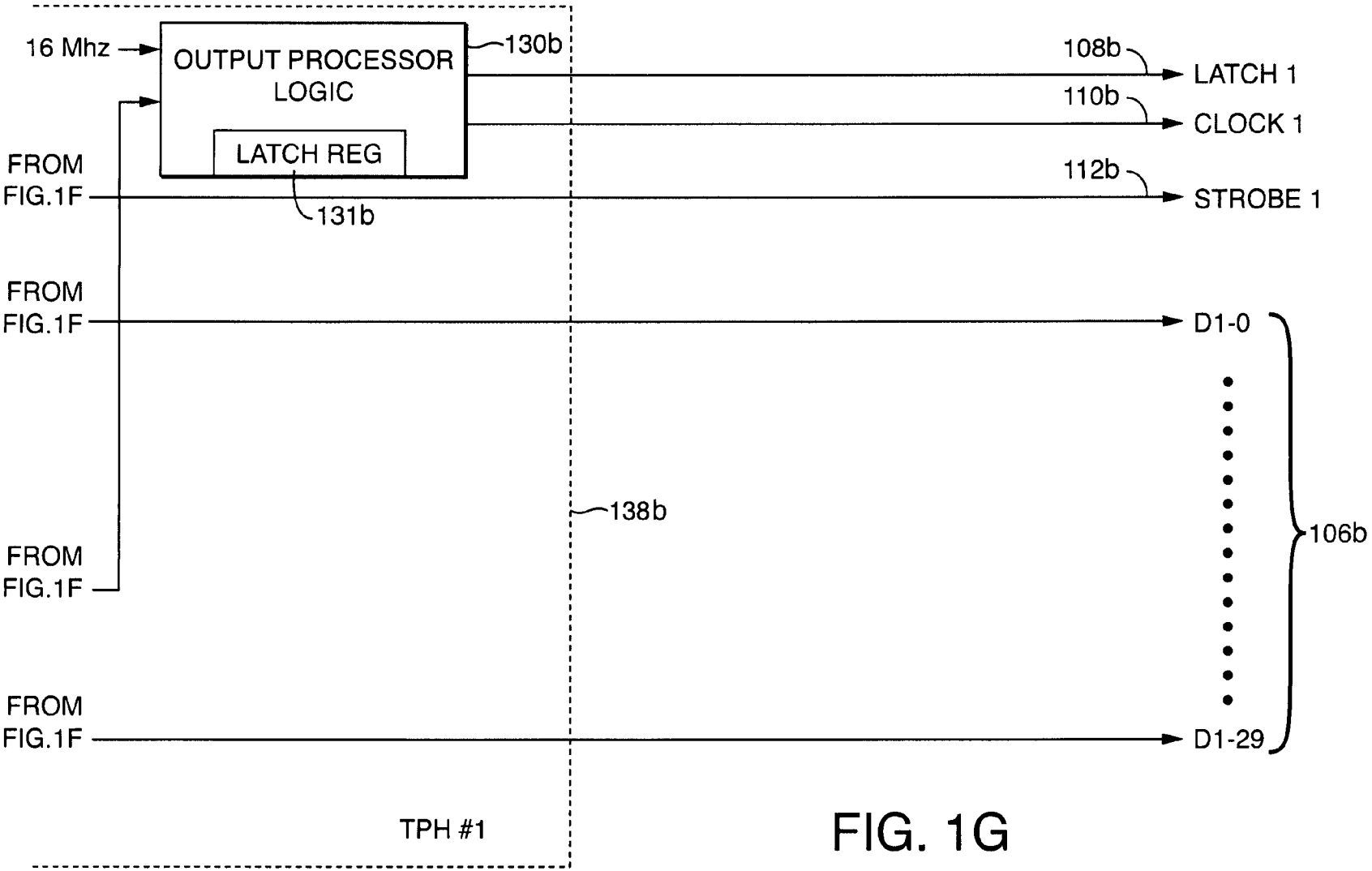
Figure 1H:
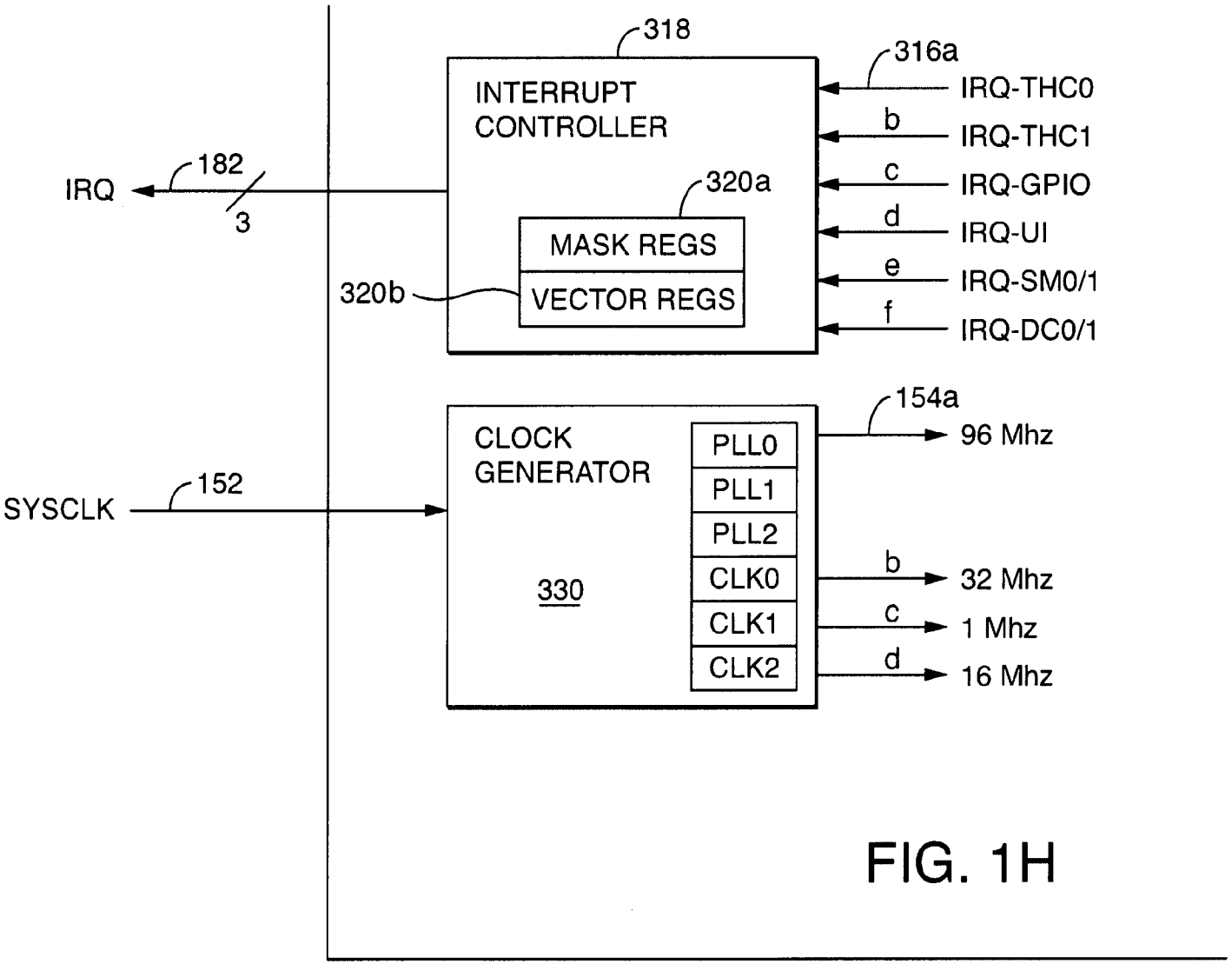
Figure 11:
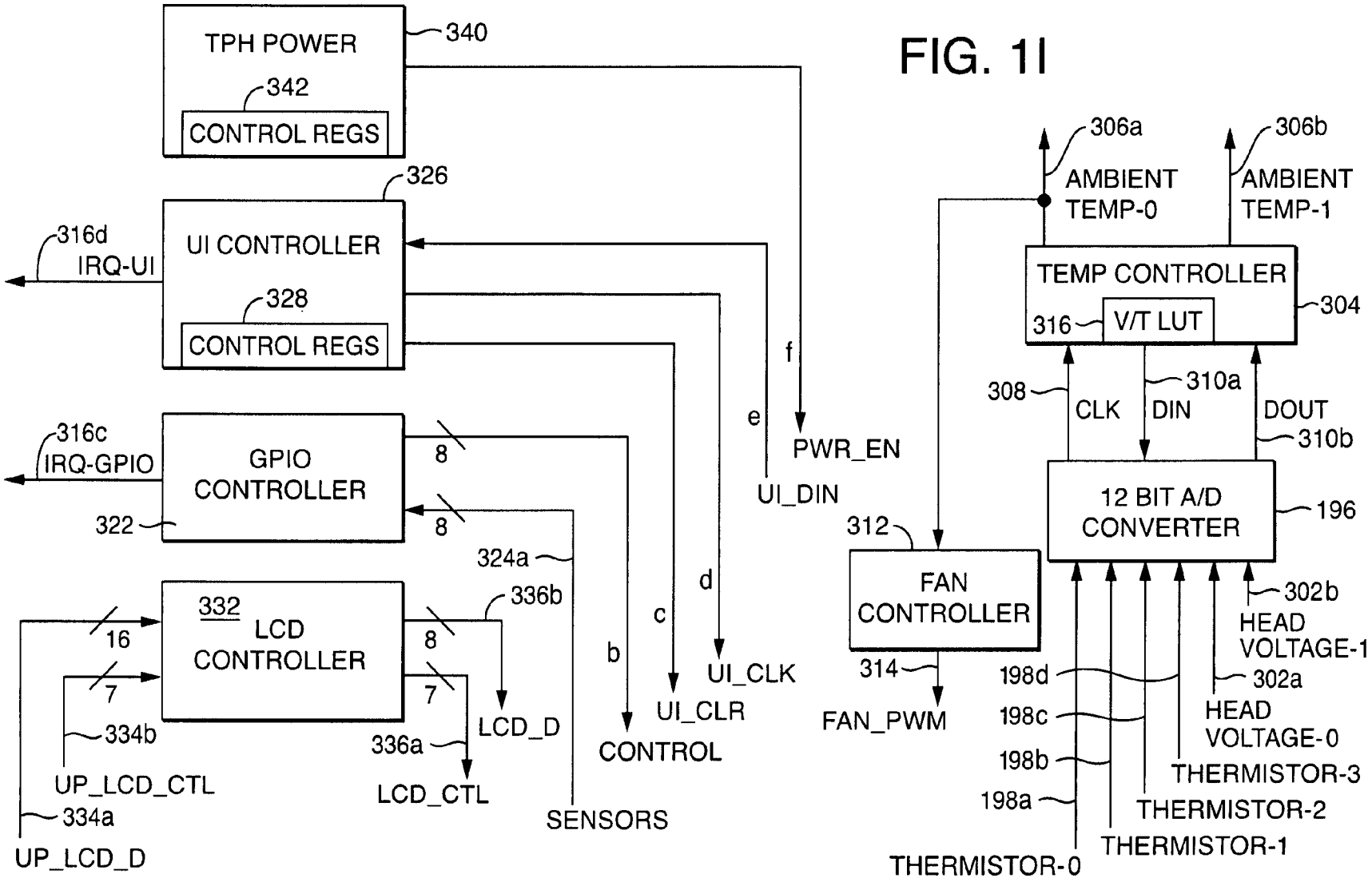
Figure 1J:
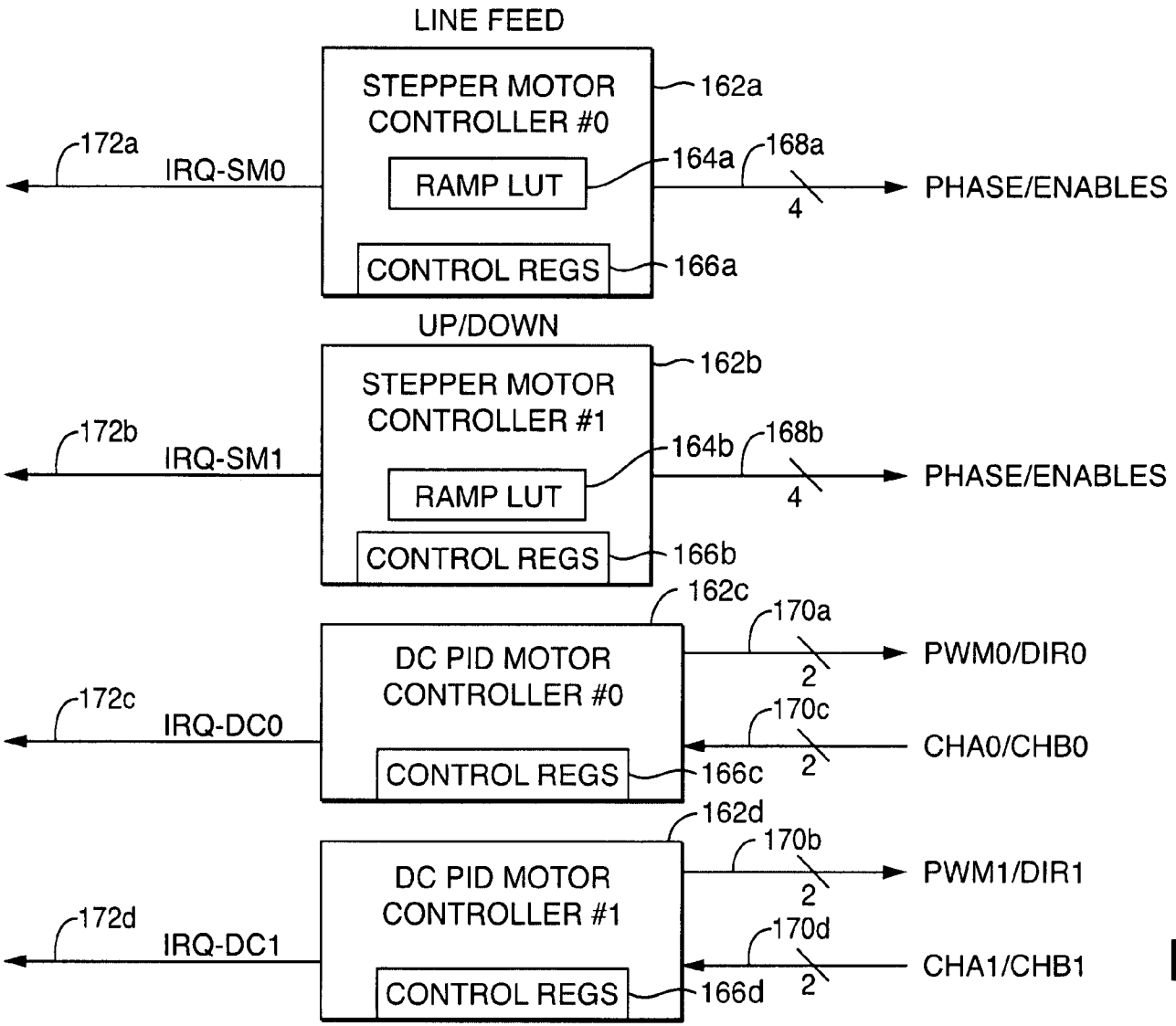
Figure 2:
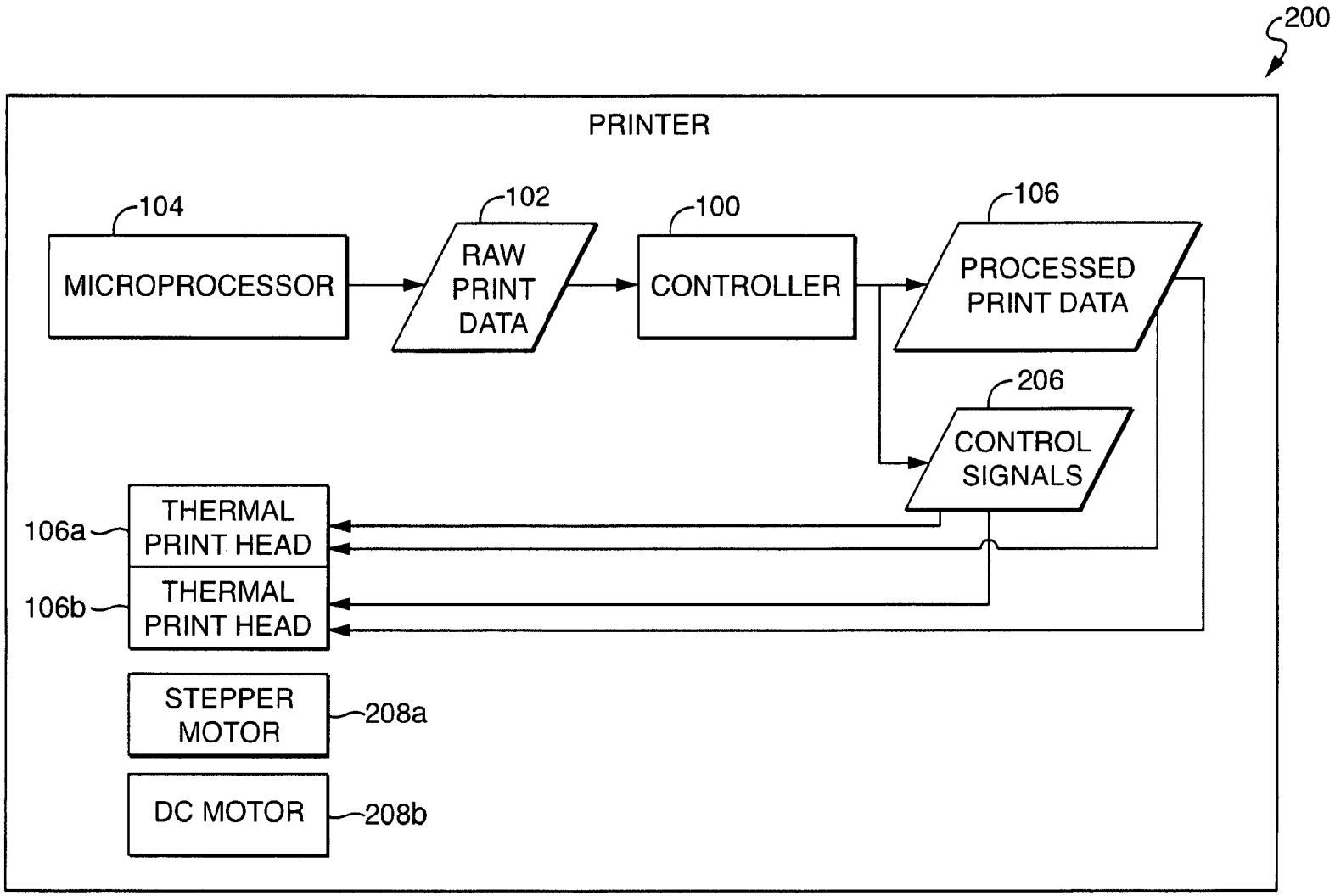
FIG. 2 is a block diagram of a printed according to one embodiment of the present invention.

Referring to FIGS. 1A-1J, block diagrams are shown of a thermal print head controller 100 according to one embodiment of the present invention. FIGS. 1A-1J may be referred to collectively herein as FIG. 1. Referring to FIG. 2, a block diagram is shown of a printer 200 including the controller 100 according to one embodiment of the present invention. In general, the controller 100 accepts pixel data 102 from an image processing component (e.g., an external microprocessor 104), formats the pixel data 102 into a number of sub-pixel cycles, grows the sub-pixels, and sends the resulting data 106, along with latch 108, clock 110, and strobe signals 112 (shown collectively in FIG. 2 as control signals 206) to a pair of thermal print heads 106*a-b*. The controller 100 includes two parallel print engine controllers 138*a-b*, each of which processes data corresponding to a print head 106*a* or 106*b*. The same circuitry is duplicated in both of the print engine controllers 138*a-b*.

As shown in FIG. 2, the printer 200 includes the microprocessor 104, which transmits the raw print data 202 to the controller 100. Secondary tasks performed by the controller 100 may include controlling general purpose I/O, motor control, and temperature control, as well as providing support for enabling low-power features of the circuit board. In the embodiment illustrated in FIG. 1, the controller 100 is implemented on a single Application-Specific Integrated Circuit (ASIC). Alternatively, the controller may be implemented on a single Field-Programmable Gate Array (FPGA) or in other circuitry. In one embodiment of the present invention, code for the controller 100 is written to conform to the IEEE Standard Hardware Description Language (HDL) based on Verilog® Hardware Description Language (IEEE Std. 1364-1995).

Various initialization steps may be performed before using the controller 100. For example, print engine controllers 138*a-b* in the controller 100 includes thermal history control (THC) engines 136*a-b*. Each of the THC engines 136*a-b* may be programmable. Therefore, during initialization of the controller 100, a THC program that implements the desired THC algorithm may be loaded into THC code memory 190*a-b*. Note, however, that any program may be loaded into the THC code memory 190*a-b*. For example, JPEG compression/decompression code may be loaded into the THC code memory 190*a-b*. In this way, the THC engines 136*a-b* may be used to perform functions other than thermal history control, either temporarily or permanently.

Associated with THC engines 136*a-b* are G/S LUTs 158*a-b*. These LUTs 158*a-b* are described in more detail in the above-referenced patent application entitled "Thermal Response Correction System." Appropriate lookup table values may be loaded into the LUTs 158*a-b* during initialization of the controller 100.

Furthermore, although the embodiment illustrated in FIG. 1 includes two print engine controllers 138*a-b*, one for each of the thermal print heads 106*a-b* (each of which may print a distinct color or combination of colors), this is not a requirement of the present invention. For example, the controller 100 may include only a single pathway (such as the pathway 138*a*) that is used to control and provide data for a multiple pass thermal printer. In such a case, the G/S LUTs 158*a* may be loaded with a first set of LUT values when being used to provide data to the first pass, and be loaded with a second set of LUT values when being used to provide data for the second or third pass. The contents of the G/S LUTs 158*a* may, therefore, vary during printing.

Each of the print engine controllers 138*a-b* also includes its own control registers 154*a-b* and parameter registers 156*a-b*. Examples of the control registers 154*a-b* will be described in more detail below. Examples of parameter values that may be stored in the registers 156*a-b* include values for the variables α, A, and K, which are used by the THC engines 136*a-b*, as described in the above-referenced patent application entitled "Thermal Response Correction System." As with the G/S LUTs 158*a-b*, the contents of the registers 154*a-b* and 156*a-b* may be varied during printing if only one of the print engine controllers 138*a-b* is used to control and provide data for all print passes.

The print engine controllers 138*a-b* include their own segment processors 132*a-n* and 134*a-n*. The print engine controllers 138*a-b* further include their own output processors 130*a-b*. Segment processors 132*a-n* and output processor 130*a* share configuration registers 184*a*, while segment processors 134*a-n* and output processor 130*b* share configuration registers 184*b*. The configuration registers 184*a-b* are initialized during initialization of the controller 100. Examples of the configuration registers 184*a-b* will be described below.

Print engine controllers 138*a-b* include Common Mode Voltage (CMV) correction engines 144*a-b*, respectively. Each of the CMV engines 144*a-b* includes its own LUT, which is initialized during initialization of the controller 100. The operation of the CMV engines 144*a-b* and the LUTs 150*a-b* are described in more detail in the above-referenced patent application entitled "Method and Apparatus for Voltage Correction."

Having described the operation of the controller 100 in general, the operation of the controller 100 will now be described in more detail according to various embodiments of the present invention. Image processing is handled by the external microprocessor 104, which communicates with the controller 100 through a microprocessor interface 126 over lines 102, 118, 120, 122, and 124. Data received from the microprocessor 104 is stored in input buffers 128*a-b*.

More specifically, the microprocessor 104 sends two pixels of desired density with each write transfer to the microprocessor interface 126, which stores the pixels in the device input buffers (FIFO) 128*a-b*. In one embodiment of the present invention, each of the input buffers 128*a-b* is 384×16 and requires the microprocessor 104 to send 4 blocks (256 bytes each) per image line (1024 pixels total). Flow control into and out of the input buffers 128*a-b* is controlled by the corresponding output processors 130*a-b*. When the buffers 128*a-b* are full, a bit is set in the configuration registers 154*a* signaling to the THC engines 136*a-b* that the data in the buffers 128*a* is ready to be processed. The THC engines 136*a-b* then empty the data from the buffers 128*a-b* while performing thermal history control on the data. When the THC engines 136*a-b* empty the buffers 128*a*, the THC engine generates an interrupt signal on lines 186*a-b*, respectively. In response to the interrupt, the microprocessor 104 transmits the next line of data into the buffers 128*a-b*. Alternatively, the DMA controller could signal for the transfer of image data without intervention from the CPU.

The THC engines 136*a-b* maintain intermediate versions of the current line being processed in intermediate buffers 188*a-b*, respectively. When the THC engines 136*a-b* finish processing the current line, the THC engines 136*a-b* write the processed line into the segment processors 132*a-b* and 134*a-n*, respectively. For reasons well-known to those having ordinary skill in the art, the output of a thermal printer may contain nonuniformities. Nonuniformity correction may be performed, for example, between the THC engines 136*a-b* and corresponding segment processors 132*a-n* and 134*a-b* using any of a variety of techniques. A 6-bit dither matrix may also be provided to extend the effective dynamic range of the system and reduce or eliminate visible density level contouring.

Segment processors 132*a-n* include buffers 146*a-n*, and segment processors 134*a-n* include buffers 148*a-n*. Each buffer is capable of holding three complete lines of data, and each of the segment processors 132*a-n* and 134*a-n* may be dual-ported such that each segment processor has a line side and a sub-pixel side. With this configuration, each new line can be sent from the microprocessor 104, while the old line is undergoing sub-pixel generation and transmission to the thermal print heads 106*a-b*. Three lines of buffered data are used in this embodiment because pulsing for certain colors will cross a line boundary if multiple colors are printed in a single pass.

In the embodiment illustrated in FIG. 1, each of the segment processors 132*a-n* and 134*a-n* is capable of accepting either 64, 96, or 128 bytes of data. These byte counts in each data line are values are found in typical commercial TPHs. The output of each of the segment processors 132*a-n* is provided to a corresponding data line in the print head 106*a*. Similarly, the output of each of the segment processors 134*a-n* is provided to a corresponding heating element in the print head 106*b*.

Output processors 130*a-b* generate clock signals 110*a-b* (which clock each bit of data provided by the segment processors 132*a-n* and 134*a-n* to the print heads 106*a-b*), latch signals 108*a-b*, which latch each line of data provided to the print heads 106*a-b*, and strobe signals 112*a-b* that are used to energize the print heads 106*a-b*. Output processors 130*a-b* include registers 131*a-b*, respectively, for storing the phase differences (if any) between latch signals 108*a-b* and corresponding clock signals 110*a-b* and strobe signals 112*a-b*.

Note that although two print heads 106*a-b* and two corresponding sets of segment processors 132*a-n* and 134*a-n* are shown in FIG. 1, this is not a requirement of the present invention. Rather, there may be any number of segment processors and, as described in more detail below, the controller 100 may be programmed to utilize the number of segment processors that are currently active. An appropriate number of output data lines may then be wired to the active segment processors. In this way, the number of segment processors may be varied without modifying the remaining design of the controller 100. This embodiment implies a massively parallel implementation providing no loss in print speed as the width of the TPH increases.

The THC engines 136*a-b* may be enabled or disabled. For example, in one embodiment of the present invention, writing data to a first set of addresses in the microprocessor interface 126 writes data to the THC engines 136*a-b*, while writing data to a second set of addresses in the microprocessor interface 126 writes data directly to the segment processors 132*a-n* and 134*a-n*, thereby bypassing the THC engines 136*a-b*. Multiplexers 140*a-b* may be used to select the output of either the microprocessor interface 126 or the THC engines 136*a-b* as input to the segment processors 132*a-n* and 134*a-n*.

Line FIFOs 194*a-b* may be used for debugging purposes. More specifically, line FIFOs 194*a-b* may store the outputs of the THC engines 136*a-b* for subsequent analysis by the microprocessor 104.

The printer 200 (FIG. 2) also includes a stepper motor 208*a* and a DC Proportional Integral Derivative (PID) motor 208*b*. Controller 100 includes a line feed stepper motor controller 162*a* and an up/down stepper motor controller 162*b* for controlling the stepper motor 208*a*. Similarly, the controller 100 includes a line feed DC motor controller 162*c* and an up/down DC motor controller 162*d* for controlling the DC motors 208*b*. Once the motor acceleration ramp has completed, the motor controllers 162*a-d* generate interrupts (on lines 172*a-d*) to the microprocessor 104 indicating that printing has begun. In response, the microprocessor 104 begins sending print data as described above.

The controller 100 includes a temperature control section which includes an analog/digital (A/D) converter 196 coupled to a temperature controller 304. The A/D converter 196 receives thermistor readings on lines 198*a-d* (representing temperatures of the print heads 106*a-b*) and voltage readings on lines 302*a-b* (representing voltages of the print heads 106*a-b*). Wider TPHs may contain multiple thermistors. The A/D converter 196 converts these analog signals into digital form on line 310*b*. Temperature controller 304, which is clocked by a clock signal on line 308, includes a Voltage/Temperature (V/T) LUT 316 which maps voltages to temperatures. The temperature controller 304 uses the V/T LUT 316 to convert the voltages provided by the A/D converter 196 into ambient temperatures, which are output on lines 306*a-b*. The A/D converter 196 may contain gain and offset registers that require initialization. This is accomplished via the data on line 310*a*. The THC engines 136*a-b* use these ambient temperature readings to perform thermal history control, as described in more detail in the above-referenced patent application entitled "Thermal Response Correction System." In one embodiment of the present invention, the thermistor readings on lines 198*a-d* and the head voltage readings on lines 302*a-b* are taken every line, thereby allowing the ambient temperature readings provided to the THC engines 136*a-b* on lines 306*a-b* to be updated every line. The controller 100 also includes a fan controller 312 which can be used to adjust the speed of an external fan (not shown) depending on the detected internal temperature of the printer 200. The temperature controller 304 also contains circuitry to maintain a running average of the converted thermistor voltage readings. This running average will ensure that noise in the system can be filtered out.

The controller 100 also includes a General Purpose I/O (GPIO) controller 322 that can be used to perform various I/O functions. The GPIO controller 322 transmits interrupts to interrupt controller 318 on interrupt line 316*c*. GPIO controller 322 receives input on sensor lines 324*a* and provides control output on lines 324*i*.

The controller 100 also includes a user interface (UI) controller 326 which includes various control registers 328. The UI controller 326 receives input from up to 16 input devices on line 324*e* and provides control output on line 324*c*, which is clocked by a clock signal on line 324*d*. The UI controller transmits interrupts to interrupt controller 318 on interrupt line 316*d*.

The controller 100 also includes a clock generator 330 for generating clock signals on lines 154*a-d*. It should be appreciated that the particular clock signals shown in FIG. 1 are merely examples and that any number of clock signals having any clock frequencies may be used.

The printer 200 may include a display such as a liquid crystal display (LCD) for displaying information to the user. The controller 100 includes an LCD controller 332 for receiving parallel input from the LCD controller (on lines 334*a-b*) and providing serialized output to the LCD device (on lines 336*a-b*) using techniques that are well-known to those having ordinary skill in the art.

In the example shown in FIG. 1, the microprocessor 104 must source one clock for use within the controller 100. In one embodiment of the present invention, the system clock is 100 MHz, and the additional clocks required for internal processing (96 MHz) and motor drive (1.0 MHz) are derived from an internal DLL (not shown). The circuits in the thermal print heads 106*a-b* use a 48 MHz enable signal generated from the 100 MHz clock to generate interface control signals at 16 or 24 MHz.

In one embodiment, as a pixel exits the thermal history control processors 136*a-b*, its value can be based on a eight-by-eight non-overlapping "superpixel" and defined with a possible number of 240*4 sub-pixel cycles, or a maximum value equal to 960. A 6-bit round-robin dithering matrix is applied to each input pixel to obtain an output value between 0 and 240. This pixel value sent to the Output Processor 130*a-b* is fed back to the THC engines 136*a-b*, to ensure all energy sent to the TPHs is compensated for.

Each of the output processors 130*a-b* contains circuits necessary to process, in real-time, one line of pixels. While the present line of data is active at the thermal print head 106*a-b*, the output processors 130*a-b* will queue the next line output from the microprocessor 104 or thermal history control engines 136*a-b*.

At the core of output processors 130*a* and 130*b* are segment processors 132*a-n* and 134*a-n*, respectively. There may be any number of segment processors. In the example illustrated in FIG. 1, there are 30 segment processors in each of the print engine controllers 138*a-b*. If there are n segment processors, each segment processor is responsible for processing 1 nth of the complete line, where 'n' refers to the number of data lines per TPH. Input to the segment processors 132*a-n* and 134*a-n* is written by the microprocessor interface 126 or the thermal history control engines 136*a-b*. The output of the segment processors 132*a-n* and 134*a-n* is input to the common mode voltage correction circuits 144*a-b*, respectively, where proper strobe timing signals 112*a-b* and data latch signals 108*a-b* for the thermal print heads 106*a-b* are generated.

Consider as an example a case in which there are 1280 pixels per line and each of the thermal print heads 106*a-b* has 10 data lines. The microprocessor interface 126 or thermal history control engines 136*a-b* are responsible for sending ten 128-pixel image blocks to the segment processor DPRAMs 146*a-n* and 148*a-n* per line. Since the microprocessor interface 126 in this example is 2 bytes wide, it can do this in 10*(128/2) writes. With this in mind, once the microprocessor interface 126 (or THC 136*a-b*) has sent the first line of pixels, it must wait for a "sending line" flag interrupt. This "wait" time should be on the order of 10 milliseconds, roughly the time to expose one line of pixels, based on the print speed. Once the sending line interrupt has occurred, the CPU 126 (or THC 136*a-b*) can send the second image line to the input buffers 146*a-n* and 148*a-n*.

Each of the segment processors 132*a-n* and 134*a-n* contains a single Block of Dual Ported RAM (DPRAM) 146*a-n* and 148*a-n* configured as 128×16. One port of the DPRAMs is for the microprocessor interface 126 (or the THC 136*a-b*) to write into, and the other is for the current line output side. Each location contains an odd and an even pixel byte. Line side processing controls writes to the RAM, while sub-pixel side processing controls reads from the RAM. A write access to the RAM (left side) shall always be in opposite bank to that of a simultaneous read access to RAM (right side), as controlled by a bank select line. Just as in line processing, the data for the next sub-pixel cycle is processed and shifted to the thermal print head data array while the current sub-pixel cycle is active. When the current sub-pixel cycle is complete, the newly shifted data is then latched and becomes the current data driven (heated) by the TPH. This process repeats itself until all sub-pixel cycles for the present line are processed, and the data for the first sub-pixel cycle of the next line have been shifted to the thermal print head data array and awaiting its latch.

Each image byte sent by the microprocessor 104 should represent the number of sub-pixels that will be "on" for each given pixel. In one embodiment of the present invention, there are 1330 sub-pixels per pixel. Thus, a valid image byte can contain a value from 0-255.

Once Output Processors 130*a-b* are enabled, internal device 'sub-pixel timing & control' commences until stopped by the CPU, or the flow of image pixels is broken. The flow of image pixels must continue to ensure the Output Processors

130*a-b* do not reuse old image pixels. Therefore, the Output Processors 130*a-b* will stop generating Sending Line interrupts 316*a-b* if new image pixels do not arrive from the CPU.

In one embodiment of the present invention, timing parameters are as follows: System Input Clock Freq: 100 MHz (10 nS); Internal Processing Clock Freq: 96 MHz; Head Clock Freq: 16 or 24 MHz); Approx. Transfer Time 1: 6.4 uS (1280 pixels to segment processors); Line Time: 1.9 msec (240 sub-pixels* 128 pixels @ 16 MHz); Number of Sub-pixels/Pixel: 240 (150 KHz Sub-pixel rate); Sub-pixel cycle Time: 6.667 usec (640 clock cycles @ 96 MHz).

While the present line of pixel data is being processed, the microprocessor interface 126 sends image block(s) to the DPBRAMs 128*a-b* for the next line after getting an interrupt from the "sending_line" flag stored in the interrupt vector. This ensures that new processed image data will never over write old image data.

From this point forward the Output Processor 130*a-b* will interrupt the microprocessor 104 when the present-line exposure is complete. At this time, the Output Processor 130*a-b* will move to the next image line. The pointers to the current image lines to process move in a modulo fashion. The microprocessor 104 uses this interrupt as a signal to send the next image line to the input buffers 128*a-b*.

The controller 100 will continue to process line after line until told to stop. When the microprocessor interface 126 receives a sending line interrupt that will cause it to upload the last line of the image plane to the input buffers 128*a-b*, the microprocessor interface 126 performs this transfer, waits for the final sending line interrupt, and then commands the controller 100 to stop exposure of the panel by disabling the THC engine and the Output processor.

In one embodiment of the present invention, the controller 100 grows pixels using variable dots. Pixel growth can be either top down, bottom up, center growth, or alternating between top down and bottom up.

In one embodiment of the present invention, active strobe timing to the thermal print heads 106*a-b* is adjusted (lengthened) based on the number of bits that are "on" for any given sub-pixel cycle within a pixel. It is assumed that active strobe time will never exceed 95% of the latch or sub-pixel cycle. In one embodiment, a processor 'base' value equal to 80% of this maximum latch time is written to the controller 100 in the Output Processor 130*a-b* to set the minimum active strobe time. This number for example is equal to 6.333 usec(0.80)=5.0667 usec or 608(0.80)=486 clock cycles. This base value is stored in a Common Voltage Correction Base Value register to give the processor 104 control over the minimum active time. For an 80% value, the processor 104 would therefore write a value equal to 0×1E6 to the Output Processor 130*a-b* prior to exposure.

The difference value (95%-80%, or 122 clock cycles) is therefore the maximum total time that can be added to the base value to increase the effective strobe time to the print heads 106*a-b*. The fraction of the 122 clock cycles to be added to the base is determined by the number of "on" pixels within the sub-pixel cycle.

Each of the segment processors 132*a-n* and 134*a-n* supplies up to 128 pixels of the image. The number of "on" pixels for the sub-pixel is totaled by each of the segment processors 132*a-n* and 134*a-n*. The output processors 130*a-b* then sum the totals from each active segment processor. This value is used as an address into a Common Voltage Correction Adjustment LUT 150*a-b*.

In one embodiment of the present invention, the RAMs 150*a-b* are Dual-Port RAMs (DPRAMs). The microprocessor sides of the RAMs 150*a-b* are configured as 4096×16, while the sub-pixel sides are configured as 4096×10. The microprocessor interface 126 loads correction values to the LUT 150*a-b* directly by the microprocessor interface.

For each sub-pixel cycle, the addressed byte in the LUTs 150*a-b* is then added to the base correction value to obtain the total active strobe time 112*a-b* to the print heads 106*a-b*. The LUTs 150*a-b* are un-initialized with data at power-up/configuration.

The clock signals 110*a-b* provided to the thermal print heads 106*a-b* are divided, gated versions of the 100 MHz system clock 152. While not in active exposure, the clocks 110*a-b* will idle at a logic "low" level. The data 106*a-b* will transition on the rising edge of the clocks 110*a-b*. Note that there may be any number of lines in the data 106*a-b*. For example, for 128 pixels, one data out line is driven. For 1280 pixels, 10 lines are driven.

The latch signals 108*a-b* are active "low" with a pulse width equal to approximately 180 nsecs. One latch will occur for each sub-pixel cycle within the line.

The strobe signals 112*a-b* are active "low" and will occur just after an active latch for each sub-pixel cycle within the line. Pulse width is determined by the required energy levels and adjusted by the common voltage correction engines 144*a-b* for each sub-pixel.

In one embodiment, the invention is implemented in a Field Programmable Gate Array (FPGA). As is well-known to those having ordinary skill in the art, an FPGA includes a plurality of registers in which control information may be stored.

The FPGA may include a plurality of registers 154*a-b* and 156*a-b* for storing parameters for the Thermal History Control engine. Such registers may include, for example:

- a register to control the THC Engine and to synchronize it to the CPU. This register may include the following bits:
  - a. a THC IDLE bit for enabling a "THC idle mode" which permits the thermal history control engines 136*a-b* to continuously process constant data (see IDLE MODE DATA register) to establish a cool-down mode for the THC algorithm.
  - b. A THC Readback bit for selecting the Line FIFO input data path of THC processed pixels. It may select, for the example, the THC output directly or the after profile correction output for post analysis by the CPU.
  - c. a FIFO LOADED bit indicating that a complete line of image data has been loaded into the THC input FIFO from the input buffers 128*a-b*. This bit should be strobed high by the microprocessor interface 126 after writing a line of data into the FIFO.
  - d. a THC ENABLE bit which is used by the THC algorithm to begin processing image data for thermal history. As long as this bit is active high and the thermal history control engines 136*a-b* are enabled, thermal history control will be enabled. When this bit is low, all thermal history will be initialized to the ambient state.
  - e. a CONFIGURATION RESET bit which resets the THC Configuration address counters.
  - f. a PROCESSOR RESET bit which resets the thermal history control engines 136*a-b*.
  - g. a PROCESSOR ENABLE bit which enables the thermal history control engines 136*a-b* to begin executing instructions from their program memory 190*a-b*. When the thermal history control engines 136*a-b* are disabled, the microprocessor interface 126 may initialize thermal history control parameters using values stored in parameter registers 156*a-b* and load the thermal history control memories 190*a-b*. For example, S/G LUTs may be loaded into memories 158*a-b* in the thermal history control engines 136*a-b*. Additionally, when the thermal history control engines 136*a-b* are disabled, thermal history control processing is bypassed and the output processors 130*a-b* could process data written directly from the microprocessor interface 126. Note that multiplexors 140*a-b* may be used to select the output of the thermal history control engines 136*a-b* when they are active and to provide data directly from the microprocessor interface 126 when the thermal history control engines 136*a-b* are not active.

a THC Ambient Temperature register. This register may include both an integer field (e.g., of 7 bits) representing the temperature in centigrade of the temperature sensor and a fractional field (e.g., of 8 bits) representing the temperature in 0.00390625 degrees centigrade of the temperature sensor. The thermal history control engines 136*a-b* may use their own internal temperature controllers to update the thermal print head temperatures, but this register permits the microprocessor to update the temperature manually using ambient temperature lines 160*a-b* (coupled to lines 306*a-b*). This register should be updated just prior to exposing the media and/or during exposure for continuous temperature update. This manual register may also be used to manipulate the true temperature to compensate for external stimuli like the print platen heating up, and humidity effects.

a THC Max Sub-pixel register. This register defines the maximum number of sub-pixel cycles allowed for pixel densities produced by the thermal history control engines 136*a-b*. Pixel densities from the thermal history control engines 136*a-b* will be clipped to be between 0 and the maximum sub-pixel value.

a THC Thermal Print Head Size register. This register defines the number of print head elements in the corresponding thermal print head 106*a-b*. This parameter, along with THC decimation factors (see below), is used by the THC engines 136*a-b* to calculate internal array sizes.

a THC Decimation register. This register may contain, for example, a layer 0 to layer 1 time decimation factor, a layer 1 to layer 2 time decimation factor, a layer 0 to layer 1 spatial decimation factor, and a layer 1 to layer 2 spatial decimation factor. The decimation factor designates the binary power of the desired decimation. For example, a decimation factor of 0 corresponds to a decimation of 1, a decimation factor of 1 corresponds to a decimation of 2, a decimation factor of 2 corresponds to a decimation of 4, and a decimation factor of 3 corresponds to a decimation of 8. The use of decimation factors in a multi-layer thermal model is described in more detail in the above-referenced patent application entitled "Thermal Response Correction System."

a THC Layer 2 Parameter Memory Data register. This register allows writing to the Layer 2 Parameter Memory. This register stores a Layer 2 alpha constant, a Layer 2 A constant, a Layer 2 k constant, a Layer 2 (1-2k) constant, a Layer 2 E array address, a Layer 2 array size, a Layer 2 T array address, a Layer 2 Ta array address, and a Layer 2 Slope array address. These constants are described in the above-referenced patent application entitled "Thermal Response Correction System.". Successive writes to this register will sequentially fill the parameter memory beginning at memory address 0. This address is automatically generated and incremented by the hardware. Strobing the "Configuration Reset" bit high (in the THC Control register) will reset the memory address counter to zero.

A THC Layer 1 Parameter Data register. This register allows writing to the Layer 1 Parameter Memory. Successive writes to this register will sequentially fill the parameter memory beginning at memory address 0. The address is automatically generated and incremented by the hardware. Strobing the Configuration Reset bit high (in the THC Control register) will reset the memory address counter to zero. This register stores a Layer 1 alpha constant, a Layer 1 A constant, a Layer 1 k constant, a Layer 1 (1-2k) constant, a Layer 1 E array address, a Layer 1 array size, a Layer 1 T array address, a Layer 1 Ta array address, a Layer 1 Slope array address, a Layer 1 Time loop count (equal to $2^{(time_decimation_factor)}$), and a Layer 1 Spatial loop count (equal to $2^{(spatial_decimation_factor)}$). These values are described in the above-referenced patent application entitled "Thermal Response Correction System."

a THC Layer 0 Parameter Data register. This register allows writing to the Layer 0 Parameter Memory and operates in the same manner as the THC Layer 1 Parameter Memory Data register, described above.

a THC S/G Lookup Table Data register. This register allows writing to the S/G LUTs 158*a-b*. Successive writes to this register will sequentially fill the S/G LUT memory beginning at memory address 0. The address is automatically generated and incremented by the hardware. Strobing the "Configuration Reset" bit high (in the THC Control register) will reset the memory address counter to zero. The S and G LUT data are interleaved so that the G LUT data are written on even addresses, and so that the S LUT data are written on odd addresses. Each LUT is 256×16. Therefore, the microprocessor interface 126 should write to this register 512 times in order to fill both LUTs 158*a-b*. In a two-color implementation, the table is twice the depth of the table in a one-color implementation. In such a case, the S/G LUTs 158*a* for color 1 are loaded first, followed by the S/G LUTs 158*b* for color 2.

a THC Program Memory Data register. This register allows writing to the THC Processor Program Memory 190*a-b*. Successive writes to this register will sequentially fill the Program memory 190*a-b* beginning at memory address 0. This address is automatically generated and incremented by the hardware. Strobing the "Configuration Reset" bit high (in the THC Control register) will reset the memory address counter to 0.

a THC Constant Pool Memory Data register. This register allows writing to the THC Processor Constant Pool Memory. Successive writes to this register will sequentially fill the Constant Pool memory beginning at memory address 0. The address is automatically generated and incremented by the hardware. Strobing the "Configuration Reset" bit high (in the THC Control register) will reset the memory address counter to zero. The THC Constant Pool Memory holds program constant values that are larger than 8 bits. Constant values that are 8 bits or smaller can be specified within the 16-bit instruction code itself. Larger values are placed in the Constant Pool memory, and the instruction code accesses the value from this memory.

a THC Profile Correction and De-Correction Lookup Table register. This register allows writing to the THC Profile Correction and De-Correction LUTs. These LUTs are used to compensate for system uniformity corrections. These corrections may include resistive non-uniformity of the TPH, TPH to platen mis-alignment, pressure difference along the TPH, etc. . . . Successive writes to this register will sequentially fill the LUTs beginning at memory address 0. The address is automatically generated and incremented by the hardware. Strobing the "Configuration Reset" bit high (in the THC Control register) will reset the memory address counter to zero. The profile correction and de-correction data are interleaved so that profile correction data are written on even addresses and de-correction data are written on odd addresses. The number of writes to this register should equal to twice the number of thermal print head elements in the corresponding one of the thermal print heads 106*a-b*. The THC Profile Correction is performed on the output of the thermal history control engines 136*a-b* the output is provided to the segment processors 132*a-n* and 134*a-n*.

a THC Pixel Data Input FIFO. This is a FIFO register port address used to upload pixel data directly to the THC engines 136*a-b*. The number of pixels uploaded to this port must match the number of pixels in the corresponding one of the thermal print head 106*a-b*. This number may be programmed in another THC register. The microprocessor interface 126 need not address each segment separately; this is performed automatically by the hardware, based on how many pixels are loaded per data line of the thermal print head. The microprocessor interface 126 writes an even and an odd pixel to this THC input FIFO with each write. For 1280 pixels per line, there will be 640 microprocessor writes to the FIFO. The THC enable bit must be set for the THC data to be used.

a THC Readback register. This is a FIFO register port address used to read back the processed pixel data directly from the THC engines 136*a-b*. The number of pixels downloaded from this port must match the number of pixels in the corresponding one of the thermal print heads 106*a-b*. The width of the port is 16 bits. The data captured by the readback FIFO can come from either of two sources: before profile correction or after profile correction. A bit in the THC Control Register is used to select the source. If the source is "before profile correction," the format of the 16-bit data is 8.8. If the source is "after profile correction," the format is 8-bits located in the lower byte of the 16-bit data (the upper byte contains zeros).

a THC Dither Matrix register. This register allows writing to the THC dither matrix. The dither matrix is used to extend the range of available sub-pixel values by spreading them over many pixels (e.g., 8 columns and 8 rows). Successive writes to this register will sequentially fill the THC dither matrix row by row beginning at memory address 0. The address is automatically generated and incremented by the hardware. Strobing the "Configuration Reset" bit high (in the THC Control register) will reset the memory address counter to zero.

a THC Idle Mode Register. This register allows writing to the THC idle mode value register. This idle mode value is continuously sent to the THC for processing. The purpose of this register is to relieve the CPU from continuously uploading constant data, freeing up bandwidth to perform other functions. The constant data could be used to preheat the TPH or let it cool down to achieve consistent starting temperatures, or in the case of D2T2 printing it can be used to expose the over coat pass.

The FPGA may include a plurality of registers for storing parameters to configure DC synchronization. DC synchronization is used for DC motor prime mover printer systems. DC synchronization is not required for stepper motor driven systems. Such DC motor systems will very typically have encoders for speed or positional feedback. This encoder can be use to synchronize the TPH pulsing to the media as printing progresses. There are two different modes implemented here. Each use a reference DC sync pulse, which is derived by counting a fixed number of encoder pulses, 16 in this implementation. The first implementation permits all sub-pixel pulsing to complete if the DC sync pulse arrives early, and waits for the DC sync pulse if all sub-pixel pulsing has not completed. This implementation operates on the basis of never terminating pulsing at the expense of position placement of printed lines. The second DC sync implementation prefers positional placement accuracy, and provides a multitude of registers to permit TPH pulsing energy to be maintained as well.

Such registers may include, for example:

a DC Motor Sync Control Register that provides control for various functions within the DC motor control circuit to synchronize Thermal Print Head Pulsing to the paper drive.

a DC Motor Start Position Register that provides a way to specify the number of encoder pulses needed before the printing should start. This value should be specified to ensure the acceleration period has expired. This register can also be used to align each pass of the print when two sided printing is used.

a DC Motor Print Line Count Register that provides control to specify the print line count.

a DC Motor Encoder Edge per Line Count Register that provides control to specify the number of encoder edges per printed line.

an Encoder Filter Register that provides control to specify the amount of debounce used on the encoder signals; and a Print Line Count Register that provides a method to read back the encoder counts.

The FPGA may include a plurality of various other registers, such as the following:

a Thermal Print Head (TPH) Power Down register. The controller 100 may include a TPH power controller 340 which includes various control registers 342, including the TPH Power Down register. This register provides a method to disable power to the corresponding thermal print head. After a countdown of the number of 1 MHz clock cycles specified in this register, the thermal print head power enable 324*f* will be removed. This register may be enabled using a bit in the Control register.

Each stepper motor controller contains a plurality of registers, such as the following:

an LF Maximum Ramp Steps register. This register controls the maximum address that is used to index the line feed ramp LUT 164*a*. During active stepping, and after this address is reached, the line feed motor will begin stepping at the frequency specified in the corresponding frequency register (see below).

a UD Maximum Ramp Steps register. This register controls the maximum address that is used to index the up/down ramp LUT 164*b*. After this address is reached, the up/down motor will begin stepping at the frequency specified in the corresponding frequency register (see below).

a Sensor Debounce Counter register. This register controls the amount of debounce used by certain inputs. The count value represents the number of 1.024 msec periods that an input must remain a solid 1 in order to be declared a "valid 1," or the number of 1.024 msec periods that an input must be a solid 0 to be declared a "valid 0." The function performed by this register may be enabled using a "Debounce Count Enable" bit in the Control register.

a Control register. This register provides control over the stepper motor hardware and may, for example, include the following bits:

a. a line feed motor Full Step bit for selecting either a half step mode or a full step mode.

b. An up/down motor full step bit for selecting either a half step mode or a full step mode.

c. A DMA enable bit for enabling or disabling GDMA.

d. A line feed motor disable bit for disabling motor windings to reduce power. p2 e. A line feed motor stop bit to command the hardware to stop stepping immediately. The hardware will complete the current step and proceed with slowdown ramp of the motor and stop. An interrupt to the CPU 126 will be sent on interrupt line 172*a* after stepping has completed.

f. A line feed motor direction bit to control the direction of the line feed motor (clockwise or counterclockwise).

g. A line feed motor enable bit to provide pass-through enable control to the motor driver.

h. An up/down motor disable bit to disable the up/down motor windings to reduce power.

i. An up/down motor stop bit to command the up/down motor hardware to stop stepping immediately. The hardware will complete the current step and proceed with slow-down ramp of the motor and stop. An interrupt to the CPU 126 will be sent on interrupt line 172*b* after stepping has completed.

j. An up/down motor direction control bit to control the direction of the up/down motor (clockwise or counterclockwise).

k. An up/down motor enable bit to provide pass-through enable control to the motor driver.

l. A debounce enable bit to enable debounce circuitry for all input sensors.

m. An 8-bit enable mode for the microprocessor interface, for selecting either a 16-bit interface or an 8-bit interface.

n. A motor select bit to select which motor (either the line feed motor or the up/down motor) the START_STEPPING_STROBE register will affect.

o. A line-feed ramp process enable bit. When this bit is set, the output processor is enabled only when the line-feed motor start-up ramp has completed. This will ensure that the motor has reached constant velocity before imaging begins. The output processor is disabled automatically when the line-feed motor has stopped.

p. A microprocessor line process enable bit. If the line-feed ramp process enable bit is zero, then when this bit is set the line will start outputting pixel data to the head for printing.

a Miscellaneous register, which provides control of various board-level I/O control signals. This register may, for example, include the following bits:

a. a data stream flip bit, which forces the segment processors 132*a-n* and 134*a-n* to flip the order of the data bits that are output to the thermal print heads 106*a-b*. Some thermal print heads have the data stream ordered from left to right, while others order it from right to left.

b. A line feed current mode bit, which provides motor current drive control for the line feed motor. This bit may indicate either a high current mode or a low current mode.

c. An up/down current mode bit, which provides motor current drive control for the up/down motor. This bit may indicate either a high current mode or a low current mode.

d. A user interface enable bit, which enables the UI circuit to scan the external UI chip for button depressions.

e. A UI debounce enable bit, which enables the debounce of the UI switches.

f. A ribbon sensor LED control bit, which can enable or disable the ribbon sensor detector LED drive signal.

g. A paper "A" sensor LED control bit, which can enable or disable the "A" paper sensor LED drive signal.

h. A paper "B" sensor LED control bit, which can enable or disable the "B" paper sensor LED drive signal.

a Common Voltage Correction Base Value register. This register permits the microprocessor interface 126 to program the nominal duty cycle of the thermal print head strobe signals 112*a-b*. The strobe signals 112*a-b* permit power to be applied to the thermal print heads 106*a-b* if a corresponding 1 was loaded into the data register.

an Input Buffer Write Port register. This is a FIFO register port address used to upload pixel data directly to the output processors 130*a-b*. Any data written to this port will bypass the THC engines 136*a-b*. This is done for calibration or debugging purposes. Bypassing the THC engines 136*a-b* will permit the calibration process to take the media's response to "raw" unprocessed pixels into account. The number of pixels uploaded to this port must match the number of pixels in the corresponding thermal print head 106*a-b*. The CPU 126 does not need to address each segment individually. This is done automatically by the hardware, based on how many pixels are loaded per data line of the thermal print head.

an Up/Down Motor Step Count register. This register sets the number of steps used by the up/down stepper motor controller 162*b* during the constant-velocity portion of the move. The total number of counts the controller 162*b* will use is this count plus the number of start-up and slow-down ramp counts.

a Line Feed Motor Step Count register. This register sets the number of steps used by the line feed stepper motor controller 162*a* during the constant-velocity portion of the move. The total number of counts the controller 162*a* will use is this count plus the number of start-up and slow-down ramp counts.

an Up/Down Motor Frequency register. This register sets the period of the step rate for the up/down stepper motor when operating under constant velocity control. After a step period has expired, the stepper motor controller 162*b* will move the motor one step. This step rate is independent of the step size (i.e., full or half).

a Line Feed Motor Frequency register. This register sets the period of the step rate for the line feed stepper motor when operating under constant velocity control. After a step period has expired, the stepper motor controller 162*a* will move the motor one step. This step rate is independent of the step size (i.e., full or half).

a Latch Line Time Register. This register sets the period of the latch signal for the corresponding thermal print head 106*a-b*. For example, if the line exposure time is desired to be 6 msecs and the number of gray levels is 240, then the latch period should be set as follows. First, the number of seconds per gray level may be calculated as: 0.006 [sec/line]/240 [line/gray levels]=0.000025 sec/gray level. Then, the latch period may be calculated as 0.000025 [sec/gray level]/(1/96000000) [cnts/sec]=2400, based on a 96 MHz clock.

a Motor Start Stepping Strobe register. This register provides a means for the CPU 126 to command a motor to begin sequencing. The target motor must first be selected by setting the motor select bit within the Control register. Writing any value to this register will command the corresponding motor to begin sequencing.

a Cumulative Count register. This register provides a means for the CPU 126 to dynamically read the cumulative count of the line feed stepper motor controller 162*a*. This register contains a VLD (valid) bit and a Cumulative Count field. The value in the Cumulative Count field is only valid if the VLD bit of the register is set. Otherwise, the controller 162*a* is updating the Cumulative Count field and the count cannot be considered valid.

a Status register. This register provides the current status of general-purpose I/O ports and sensor status. This register may, for example, include the following bits:

a. a ribbon cassette sensor bit 0 from the circuit board.

b. A ribbon cassette sensor bit 1 from the circuit board.

c. A ribbon cassette sensor bit 2 from the circuit board.

d. A bit indicating whether the line processor is sending out a line to the corresponding thermal print head 106*a-b*. The CPU 126 should only write to the segment processor dual port RAMs 128*a-b* when this bit is high.

e. A ribbon sensor level status bit which provides the current level status of the sensor. The bit passes through a debounce circuit in the FPGA within the GPIO controller 312. The debounce can be adjusted between 0 and 50 mS by setting the Debounce Enable bit and setting the Debounce Count register.

f. A Paper B Sensor Level Status bit which provides the current level status of the sensor. The bit passes through a debounce circuit in the FPGA. The debounce can be adjusted between 0 and 50 mS by setting the Debounce Enable bit and setting the Debounce Count register.

g. A paper "A" sensor status level bit which provides the current level status of the sensor. The bit passes through a debounce circuit in the FPGA. The debounce can be adjusted between 0 and 50 mS by setting the Debounce Enable bit and setting the Debounce Count register.

h. A cassette sensor bit 0 from the circuit board.

i. A cassette sensor bit 1 from the circuit board.

j. A cassette sensor bit 2 from the circuit board.

an Interrupt Mask register. This register provides for event control. Multiple bits may be set at any given time, indicating that more than one interrupt source is enabled to send signals back to the CPU 104. Each bit indicates whether the corresponding Interrupt Vector source is enabled. If an Interrupt Vector source is disabled, it cannot trigger an interrupt.

an Interrupt Vector register. This register provides event indication. An event that caused an interrupt to the CPU 104 will have its respective bit set within this register. Following a read of this register by the CPU 104, any bit that was set will be automatically cleared. Multiple bits may be set at any given time, indicating that more than one interrupt has been sent to the CPU 104. Therefore, the Interrupt Service Routine (ISR) should keep an image of this register so that once it has prioritized and serviced one interrupt, it can service any others that may have also occurred just prior to readback of this register. This register may, for example, include the following bits:

a. a User Interface Interrupt bit.

b. A bit indicating whether the first THC engine 136*a* is finished processing the last upload line.

c. A bit indicating whether the corresponding output processors 130*a-b* has begun sending a line to the corresponding one of the thermal print heads 106*a-b*. This bit indicates to the CPU 104 whether the CPU 104 may send another line of image data.

d. A bit indicating whether the first THC engine 136*a* has emptied the input FIFO.

e. A bit indicating that the second THC engine 136*b* has finished processing the last uploaded line. This bit may be redundant in systems that print with the same number of lines per inch for each TPH.

f. A bit providing an indication that the start-up ramping of the line feed motor has completed.

g. A bit indicating that the corresponding output processors 130*a-b* has begun sending a line to the corresponding thermal print head 106*a-b*. This bit indicates to the CPU 104 whether the CPU 104 may send another line of image data.

h. A bit indicating whether the second THC engine 136*b* has emptied the input FIFO. This bit may be redundant in systems that print with the same number of lines per inch for each TPH.

i. A bit indicating whether DMA transfer is complete.

j. A bit providing an indicating that the line feed motor has stopped continuous movement and has begun the slow-down ramping.

k. A bit providing an indicating that the line feed motor has completed the slow-down ramping and has stopped movement.

l. A bit indicating that the up/down motor has stopped continuous movement and has begun the slow-down ramping.

m. A bit providing an indication that the up/down motor has completed the slow-down ramping and has stopped movement.

n. A bit providing an indication that a transition has been detected on the ribbon sensor. A debounce circuit controls when the interrupt occurs if enabled.

o. A bit indicating that a transition has been detected on the "B" paper sensor. A debounce circuit controls when the interrupt occurs if enabled.

p. A bit indicating that a transition has been detected on the "A" paper sensor. A debounce circuit controls when the interrupt occurs if enabled.

a Revision register, providing access to the firmware revision number of the controller 100.

a Debug register, providing write/read access to test the bus interface of the controller 100 and to provide control over the heartbeat LED. The heartbeat LED indicates that the controller 100 has been programmed and that all system clocks are operational.

a DMA Transfer Length register. This register provides the CPU 104 with the ability to inform the controller 100 how many bytes to transfer when the DMA transfer mode is enabled. DMA controllers 174*a-b* control DMA transfers to and from the controller 100 using DMA request lines 176*a-b*, DMA acknowledge lines 178*a-b*, and DMA transfer lines 180*a-b*. The controller 100 automatically requests the specified number of bytes from the CPU 104 each time a new line of image data is requested. The DMA channels 180*a-b* from the CPU 104 must be configured for this amount, and the DMA enable bit in the control register, at a predetermined address, must be set. If the 16-bit interface mode is selected, the controller 100 divides the number of transfers by two. The CPU 104 may instruct the controller 100 to generate an interrupt on IRQ line 182 when the DMA transfer is complete.

a Strobe Duty Cycle Adjust LUT register 182*a-b*. This FIFO port permits the CPU 104 to fill the strobe duty cycle adjust LUT 182*a-b*. This data will be used to increase the strobe duty cycle based on how many print head elements are demanding power. Powering more elements will induce a drop in the power supply, and may be compensated for by extending the strobe pulse. This register allows writing to the Strobe Duty Cycle RAM register. The address is automatically generated by the hardware. Data are used to fill the Strobe Duty Cycle RAM LUT 150*a-b* with data. That data will be used to calculate the Strobe "on time."

an UD Ramp RAM Write LUT. This FIFO port permits the CPU 104 to fill the start-up/slow-down ramp LUT 164*b* for the up/down stepper motor. This data will be used to speed the motor up and then slow it down based on performing a profiled move from one position to another. The CPU 104 can write up to 2048 values to this LUT 164*b*. Each entry in the LUT represents a count delay between successive steps of the motor. The count values are based on a 1 MHz clock. The entries in this LUT typically contains values that will result in linear acceleration of the stepper motor until the final constant velocity has been reached, or in the case of stopping, the motor has reached its final destination.

a Line-Fee Ramp LUT. This FIFO port permits the CPU 104 to fill the start-up/slow-down ramp 164*a* LUT for the line-feed stepper motor. This data will be used to speed the motor up and then slow it down based on performing a profiled move from one position to another. The CPU 104 can write up to 128 values to this LUT 164*a*. Each entry in the LUT 164*a* represents a count delay between successive steps of the motor. The count values are based on a 1 MHz clock. The entries in this LUT typically contains values that will result in linear acceleration of the stepper motor until the final constant velocity has been reached, or in the case of stopping, the motor has reached its final destination.

The controller 100 may be used to expose the ZINK media disclosed in the above-referenced patent application entitled "Thermal Imaging System," which permits up to three colors to be exposed in one pass. In this embodiment of the present invention, the controller 100: (1) performs initialization (by setting up the registers described below); (2) writes six lines to the input buffers 128*a-b* to allow printing to start; (3) interrupts the microprocessor 104 when all sub-pixels in the first line have been sent; and (4) uploads up to two lines of data for each and every successive interrupt.

The Segment Processor 184*a-b* and the Output Processor Logic 130*a-b* contain control registers to control the sequencing of the TPH pulsing. In one embodiment of the present invention, this function includes the following registers:

a Maximum Sub-pixel Count register. This register permits the CPU 104 to specify the maximum sub-pixel count for each line. Once all of the sub-pixels have been completed, the hardware will interrupt the CPU 104, thereby requesting more image data.

a First Color Sub-pixel Count register. This register permits the CPU 104 to specify the maximum first color sub-pixel count. This is the color that will be pulsed with a 100% duty cycle to generate high intense heating of the thermal print head elements to expose the top color layer of the media. The second color will be pulsed at a much lower duty cycle to generate a less intense heating of the thermal print head elements to expose the second color layer of the media.

a Maximum Phase register. This register permits the CPU 104 to specify the maximum number of phases used in the system. The purpose of phasing the pixel energy is to reduce the overall power demands of the system. Phasing essentially denies all the energy required for exposing the first color to be enabled simultaneously. By setting this register to 1, there is essentially no phasing enabled and all pixels will be generated at the same time. This will draw maximum power, but also permit the fastest printing speeds. By setting this register to 2, then every even column is off until the pixels for the odd columns are finished. The total number of sub-pixels in the system would then have to be doubled, or twice the first color maximum sub-pixel value. By setting this register to 3 or more, up to 15, the energy for all columns are off until the column −1 is finished. In these cases, the maximum number of sub-pixels must be equal to at least this number multiplied by the maximum number of sub-pixels for the first color. The peak power would be incrementally reduced even more as the phasing value is increased.

a Max Pixel Per Segment Count register. This register permits the CPU 104 to specify the maximum number of pixels supported by each segment processor or pixels per data line. Each of the segment processors feed data to unique sections of the thermal print head.

a Max Data Line register. This register permits the CPU 104 to specify the maximum number of segment processors enabled in the printer. Since each segment processor drives one data bit, the value stored in this register should match the number of data lines connected to the corresponding thermal print head 106*a-b*.

Phase Delay registers. This FIFO port access is used to provide the phase delay values for each phase used, up to the maximum number of phases specified in the Maximum Phase Register. The CPU 104 must initialize these phase delay values to help simplify the parametric hardware design. A hard-wired design would not be able to accommodate many TPH configurations. The phase delay for the first column is loaded first, then 2nd, etc., until the maximum number of phase delays have been initialized. The phases should be initialized in 2's complement form because the delay is subtracted from the initial count value of the phase sub-pixel counters. The counter value is a 12-bit number permitting up to 4095 sub-pixels per line.

a Segment Processor Initial Phase register. This port access is used to provide the initial phase value required by each enabled segment processor. The modulation of variable phase delay and variable number of bits supported by each segment processor forces each initial phase delay to be unique. Therefore, the CPU 104 must initialize each segment's initial phase, to ensure the patterns it generates will align with its neighboring segment processors. A hard-wired design would not be able to accommodate many TPH configurations.

an Output Processor Control register. This register is used to adjust control output processor operating parameters. The register may, for example, include the following bits:

a. an output processor reset bit, which may be used to reset the first output processor.

b. a second color duty cycle field, which controls the frequency of the hardware's ability to generate pulses to the thermal print head for the second color. This control provides a coarse adjustment to the low intensity heating needed by the media's buried color layers. By distributing the heat at a slower rate, the heat will have the ability to migrate into the lower layers, but not be hot enough to expose the first color layer. If the media structure changes, this control bit will permit some control to adjust for varying properties such as differences in barrier thickness.

c. a head power enable bit to enable/disable the thermal print head power.

d. An output processor reset bit to reset the second output processor.

e. A first color screening mode field, which indicates whether pixels of the first color grow top down, top down/bottom up, center growth, or bottom up only.

f. A second color screening mode field, which indicates whether pixels of the second color grow top down, top down/bottom up, center growth, or bottom up only.

g. A third color screening mode field, which indicates whether pixels of the third color grow top down, top down/bottom up, center growth, or bottom up only.

h. An output processor select bit, which specifies whether the thermal print head uses a 16 MHz or 24 MHz output clock.

a User Interface Debounce register. This register is used to control the user interface switch debounce value. The debounce control can be used for either the polled or interrupt mode. The debounce circuitry prevents noisy signals from creeping into the system. Signal transitions are not recognized until a stable signal, either 1 or a 0, is seen for the entire debounce watch period. Then and only then will a signal transition be recorded into the polled or interrupt registers. If any signal transitions before the debounce period expires, the debounce period will resume at zero. This debounce is done on a bit by bit basis.

a User Interface Interrupt Mask register. This register is used to set a mask for interrupts coming from the UI interface. Each bit in the register corresponds to a user interface interrupt which can be enabled/disabled by setting/clearing the bit. Examples of user interface interrupts include left/right/up/down button interrupts, a print button interrupt, or a cancel button interrupt.

a User Interface Interrupt Vector register. This register provides for reading the values of the user interface switches at the time of an interrupt. The interrupt will be generated on either switch edge. This register clears when it is read by the microprocessor. Each bit corresponds to a user interface interrupt.

a User Interface Status register. This register provides for reading the user interface switches. The definition of the switch bit assignment will depend on how the schematic is wired. The port can also be read to get real time access to the user interface switches. The hardware will scan these switches at a rate of 1 KHz.

an A/D Control register. This register provides CPU control of the A/D temperature controller 304. This register may, for example, include the following bits:

a. a field specifying the scan sample rate in Hz;

b. a bit selecting either voltage or temperature when reading the Temperature register;

c. a field selecting the channel that is used by the CPU to read back the voltage or temperature;

d. a field selecting the number of channels converted by the controller 304;

e. a bit specifying whether to update the Thermal History Control temperatures;

f. a bit for enabling/disabling the A/D temperature controller 304 a Temperature register. This register provides CPU access to the conversion values. This register may include a Valid bit and a Temperature Conversion field. If the valid bit is set, then the value in the Temperature Conversion field is valid for use. Otherwise, the value in the Temperature Conversion field is not valid for use.

an A/D V/T FIFO Port register. This register stores the A/D temperature LUT, which may be accessed and modified by the CPU. The LUT provides for conversion of up to a 12-bit converter, or 4096 entries. The format of the temperature data is 7 bits of integer precision and 8 bits of fractional precision.

an Output Processor Latch Pulse Width register. This register provides control of the thermal print head latch pulse width. The units are in 96 MHz clock counts (approximately 10.4 nS). The latch pulse is inclusive of the line_latch_time register value. For example, if the line_latch_time register=800 and the Output Processor Latch Pulse Width register is 25, then the latch will pulse low at clock count 775 and go high at clock count 800.

an Output Processor Latch to New TPH Data CLK register. This register provides the delay count from the rising edge of the latch pulse until the next sub-pixel data can start again.

an Output Processor Strobe Delay Time register. This register provides a delay count (measured in 96 MHz clock cycles) from the rising edge of the latch to the start of the strobe signal.

an Output Processor Buried color Screening Max register. Buried color screening max is the maximum number of buried color sub-pixel s that can occur (e.g., 160 buried color pulses).

a DC_Sync Averaging Min Limit register. This is the minimum limit for acceptable DC_pulse sub-pixel count that is acceptable to be included in the DC sync moving average calculation. If the pulse comes in under this minimum limit, then the minimum limit will be used instead in the moving average.

a DC_Sync Averaging Offset register. This is an offset which can be added to the DC_Sync average value.

an Interrupt Trigger Type register. When set to a 0, the interrupt trigger will be edge type. When set to a 1, the interrupt trigger will be level type.

an Interrupt Pending Clear register. When in level interrupt mode (Interrupt Trigger Type=1), writing to this register will clear the pending set interrupt vector bits located at the corresponding bit positions.

Among the advantages of the invention are one or more of the following. Embodiments of the invention may be implemented to fit on a single FPGA or ASIC. Previously, FPGAs were programmed to work with a particular set of printer characteristics, such as a particular print head width. Components of embodiments of the present invention, in contrast, are parameterized. For example, the number of output data lines, hold times, setup times, and number of bits per data line, are all programmable. As a result, the same controller may be used with a variety of printers by reprogramming the controller, thereby eliminating the time and expense of redesigning and remanufacturing the controller.

Furthermore, the thermal history control engines 136*a-b* are programmable. As a result, the THC algorithms can be updated merely by reprogramming the THC engines 136*a-b* with new firmware. Furthermore, the THC engines 136*a-b* may be programmed with any program to perform any function.

Another advantage of embodiments of the present invention is that the same circuitry is copied (in the two print engine controllers 138*a-b*) for two print heads 106*a-b*, so that processing may be performed for both of the print heads in parallel. Furthermore, parallel processing is employed within each of the print engine controllers 138*a-b* (by using, for example, the segment processors 132*a-n* and 134*a-n*). As a result, the speed of processing performed by the controller 100 is independent of the amount of data processed by the controller 100. Furthermore, the print engine controllers 138*a-b* may be duplicated for use with additional print heads. As a result, the speed of processing performed by the controller 100 is independent of the number of print heads controlled by the controller 100.

It is to be understood that although the invention has been described above in terms of particular embodiments, the foregoing embodiments are provided as illustrative only, and do not limit or define the scope of the invention. Various other embodiments, including but not limited to the following, are also within the scope of the claims. For example, elements and components described herein may be further divided into additional components or joined together to form fewer components for performing the same functions.

Embodiments of the present invention may, for example, be implemented in one or more Field Programmable Gate Arrays (FPGAs) and/or one or more Application-Specific Integrated Circuits (ASICs).

The techniques described above may be implemented, for example, in hardware, software, firmware, or any combination thereof. The techniques described above may be implemented in one or more computer programs executing on a programmable computer including a processor, a storage medium readable by the processor (including, for example, volatile and non-volatile memory and/or storage elements), at least one input device, and at least one output device. Program code may be applied to input entered using the input device to perform the functions described and to generate output. The output may be provided to one or more output devices.

Each computer program within the scope of the claims below may be implemented in any programming language, such as assembly language, machine language, a high-level procedural programming language, or an object-oriented programming language. The programming language may, for example, be a compiled or interpreted programming language.

Each such computer program may be implemented in a computer program product tangibly embodied in a machine-readable storage device for execution by a computer processor. Method steps of the invention may be performed by a computer processor executing a program tangibly embodied on a computer-readable medium to perform functions of the invention by operating on input and generating output. Suitable processors include, by way of example, both general and special purpose microprocessors. Generally, the processor receives instructions and data from a read-only memory and/or a random access memory. Storage devices suitable for tangibly embodying computer program instructions include, for example, all forms of non-volatile memory, such as semiconductor memory devices, including EPROM, EEPROM, and flash memory devices; magnetic disks such as internal hard disks and removable disks; magneto-optical disks; and CD-ROMs. Any of the foregoing may be supplemented by, or incorporated in, specially-designed ASICs (application-specific integrated circuits) or FPGAs (Field-Programmable Gate Arrays). A computer can generally also receive programs and data from a storage medium such as an internal disk (not shown) or a removable disk. These elements will also be found in a conventional desktop or workstation computer as well as other computers suitable for executing computer programs implementing the methods described herein, which may be used in conjunction with any digital print engine or marking engine, display monitor, or other raster output device capable of producing color or gray scale pixels on paper, film, display screen, or other output medium.

Printers suitable for use with various embodiments of the present invention typically include a print engine and a printer controller. The printer controller receives print data from a host computer and generates page information. The printer controller transmits the page information to the print engine to be printed. The print engine performs the physical printing of the image specified by the page information on an output medium.

What is claimed is:

1. A thermal printer controller comprising an integrated circuit, the integrated circuit comprising: a first thermal history control engine to receive first print data and to perform thermal history control on the first print data to produce second print data; a first common mode voltage correction engine to receive the second print data and to perform common mode voltage correction on the second print data to produce third print data; a first plurality of segment processors coupled between the first thermal history control engine and the first common mode voltage correction to buffer the second print data; and an output processor to provide the third print data to a first thermal print head.

2. The thermal printer controller of claim 1, wherein the integrated circuit further comprises the following to print on two sided media simultaneously: a second thermal history control engine to receive fourth print data and to perform thermal history control on the fourth print data to produce fifth print data; a second common mode voltage correction engine to receive the fifth print data and to perform common mode voltage correction on the fifth print data to produce sixth print data; and an output processor to provide the sixth print data to a second thermal print head.

3. The thermal printer controller of claim 2, further comprising a second plurality of segment processors coupled between the second thermal history control engine and the second common mode voltage correction to buffer the fifth print data.

4. A thermal printer controller comprising: a first thermal history control engine to receive first print data and to perform thermal history control on the first print data to produce second print data; a first common mode voltage correction engine to receive the second print data and to perform common mode voltage correction on the second print data to produce third print data; a first plurality of segment processors coupled between the first thermal history control engine and the first common mode voltage correction to buffer the second print data; an output processor to provide the third print data to a first thermal print head; and at least one element selected from the group consisting of the following: means for modifying the number of print heads for which output is produced by the thermal printer controller; means for modifying the number of output lines on which the controller transmits the third print data; and means for modifying the byte and bit order of downloading the output lines on which the controller provides the third print data; and means for modifying the number of bits in the output lines on which the controller provides the third print data.

5. A thermal printer controller comprising an integrated circuit, the integrated circuit comprising: a first thermal history control engine to receive first print data and to perform thermal history control on the first print data to produce second print data; a first common mode voltage correction engine to receive the second print data and to perform common mode voltage correction on the second print data to produce third print data; an output processor to provide the third print data to a first thermal print head; a second thermal history control engine to receive fourth print data and to perform thermal history control on the fourth print data to produce fifth print data; a second common mode voltage correction engine to receive the fifth print data and to perform common mode voltage correction on the fifth print data to produce sixth print data; an output processor to provide the sixth print data to a second thermal print head; and a second plurality of segment processors coupled between the second thermal history control engine and the second common mode voltage correction to buffer the fifth print data.

6. The thermal printer controller of claim 5, further comprising a first plurality of segment processors coupled between the first thermal history control engine and the first common mode voltage correction to buffer the fifth print data.

* * * * *